US009764556B2

(12) United States Patent
Kudo et al.

(10) Patent No.: US 9,764,556 B2
(45) Date of Patent: Sep. 19, 2017

(54) TANK, TANK UNIT AND LIQUID EJECTION SYSTEM

(71) Applicant: SEIKO EPSON CORPORATION, Tokyo (JP)

(72) Inventors: Shoma Kudo, Shiojiri (JP); Naomi Kimura, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 4 days.

(21) Appl. No.: 15/079,620

(22) Filed: Mar. 24, 2016

(65) Prior Publication Data

US 2016/0279957 A1 Sep. 29, 2016

(30) Foreign Application Priority Data

Mar. 26, 2015 (JP) ..... 2015-064061

(51) Int. Cl.
*B41J 2/175* (2006.01)

(52) U.S. Cl.
CPC ..... *B41J 2/17523* (2013.01); *B41J 2/17509* (2013.01); *B41J 2/17513* (2013.01); *B41J 2/17553* (2013.01)

(58) Field of Classification Search
CPC B41J 2/17503; B41J 2/17513; B41J 2/17523; B41J 2/17553; B41J 2/17556
See application file for complete search history.

(56) References Cited

U.S. PATENT DOCUMENTS

2006/0290753 A1* 12/2006 Tatsumi ..... B41J 2/17513 347/85
2014/0043408 A1* 2/2014 Kudo ..... B41J 2/175 347/86
2016/0009100 A1* 1/2016 Kudo ..... B41J 2/17553 347/92

FOREIGN PATENT DOCUMENTS

CN 104015492 A 9/2014

* cited by examiner

*Primary Examiner* — Geoffrey Mruk
*Assistant Examiner* — Scott A Richmond
(74) *Attorney, Agent, or Firm* — Foley & Lardner LLP

(57) ABSTRACT

The invention provides a technique for suppressing liquid leakage from a tank.
An ink tank 25A includes an ink containing portion 100. In a state in which the ink containing portion 100 contains an ink in an amount equal to ½ of its ink capacity, when the ink tank 25A is brought into an ink injection orientation, the first atmospheric air introducing inlet 114 is located in a region where the air is present, and the second atmospheric air introducing inlet 124 is located in a region where the ink is present. When the ink tank 25A is rotated upside down by 180° from that orientation and brought into a reversed orientation, the first atmospheric air introducing inlet 114 is located in a region where the ink is present, and the second atmospheric air introducing inlet 124 is located in a region where the air is present.

17 Claims, 24 Drawing Sheets

TANK, TANK UNIT AND LIQUID EJECTION SYSTEM

CROSS-REFERENCE TO RELATED APPLICATION

The entire disclosure of Japanese Patent Application No. 2015-064061, filed Mar. 26, 2015 is expressly incorporated by reference herein.

BACKGROUND

1. Technical Field

The present invention relates to a tank, a tank unit and a liquid ejection system.

2. Related Art

As one type of liquid ejection system, an inkjet printer (hereinafter referred to simply as a "printer") that forms an image by discharging ink onto print paper is known. The printer includes an ink tank attached thereto that is capable of containing ink (see, for example, CN-A-104015492).

The ink tank is usually provided with an atmospheric air communication path so that outside atmospheric air is introduced into the ink tank along with the consumption of the ink. With the ink tank, sufficient consideration is required concerning leakage of the ink contained in the ink tank through the atmospheric air communication path when the ink tank is brought into an orientation that is different from an intended normal orientation or is placed in an environment that is different from the normal environment.

SUMMARY

The invention has been made to solve at least the above-described problem of the tank that is capable of containing a liquid that is supplied to a liquid ejection head, and embodiments of the invention are not limited to ink tanks, and the invention can be implemented as follows.

[1] A first embodiment of the invention provides a tank. The tank according to this embodiment may be configured so as to be capable of supplying a liquid to a liquid ejection head. The tank may include a liquid containing portion, an atmospheric air introducing portion, a liquid injection portion and a sealing member. The liquid containing portion may be configured so as to be capable of containing the liquid. The atmospheric air introducing portion may be configured so as to be capable of introducing outside atmospheric air to the liquid containing portion. The liquid injection portion may be configured so as to be capable of injecting the liquid to the liquid containing portion from the outside. The sealing member may be detachably attached to the liquid injection portion. The atmospheric air introducing portion may include a first atmospheric air communication portion and a second atmospheric air communication portion that communicate with the liquid containing portion. The first atmospheric air communication portion may include a first atmospheric air introducing inlet that is open to the liquid containing portion. The second atmospheric air communication portion may include a second atmospheric air introducing inlet that is open to the liquid containing portion. In a state in which the liquid containing portion contains the air and the liquid in an amount occupying ½ of a capacity of the liquid of the liquid containing portion, (i) when the tank is in a liquid injecting orientation, which is an orientation when the liquid is injected from the liquid injection portion, the first atmospheric air introducing inlet is located in a region where the air is present, and the second atmospheric air introducing inlet is located in a region where the liquid is present, and (ii) when the tank is in a reversed orientation rotated from the liquid injecting orientation by 180°, the first atmospheric air introducing inlet is located in a region where the liquid is present, and the second atmospheric air introducing inlet is located in a region where the air is present. With the tank according to this embodiment, when the tank is in an orientation reversed from the liquid injecting orientation, a situation is suppressed in which both the first atmospheric air introducing inlet and the second atmospheric air introducing inlet are closed by the liquid contained in the liquid containing portion. Accordingly, a situation is suppressed in which when the tank is in the reversed orientation, the liquid containing portion is hermetically sealed from the outside, and a situation is suppressed in which the liquid contained in the liquid containing portion is forced to the outside due to the expansion of the air contained in the liquid containing portion.

[2] In the tank according to any one of the embodiments described above, the liquid containing portion may include a first wall portion, a second wall portion that is located opposite to the first wall portion, a third wall portion that is located between the first wall portion and the second wall portion in a direction extending from the first wall portion toward the second wall portion and intersects with the first wall portion and the second wall portion, and a fourth wall portion that is located opposite to the third wall portion and intersects with the first wall portion and the second wall portion. When the tank is in the liquid injecting orientation, the first wall portion may be located at a position that is lower than the second wall portion, the third wall portion and the fourth wall portion, the first atmospheric air introducing inlet may be located at a position that is closer to the second wall portion than the first wall portion and is closer to the third wall portion than the fourth wall portion, and the second atmospheric air introducing inlet may be located at a position that is closer to the first wall portion than the second wall portion and is closer to the fourth wall portion than the third wall portion. With the tank according to this embodiment, even when the tank is disposed in the reversed orientation or when the tank is disposed in an inclined state in which the third wall portion is located at a position that is lower than the fourth wall portion, a situation is suppressed in which both the first atmospheric air introducing inlet and the second atmospheric air introducing inlet are closed by the liquid contained in the liquid containing portion. Accordingly, a situation is suppressed in which when the tank is in an orientation rotated from the liquid injecting orientation, the liquid containing portion is hermetically sealed from the outside, and a situation is suppressed in which the liquid contained in the liquid containing portion is forced to the outside due to the expansion of the air contained in the liquid containing portion.

[3] A second embodiment of the invention provides a tank. The tank according to this embodiment may be configured so as to be capable of supplying a liquid to a liquid ejection head. The tank may include a liquid containing portion, a liquid supply portion, an atmospheric air introducing portion, a liquid injection portion and a sealing member. The liquid containing portion may be configured so as to be capable of containing the liquid. The liquid supply portion may be configured so as to be capable of supplying the liquid of the liquid containing portion to the liquid ejection head. The atmospheric air introducing portion may be configured so as to be capable of introducing outside atmospheric air to the liquid containing portion. The liquid injection portion may be configured so as to be capable of injecting the liquid to the liquid containing portion from the outside. The sealing member may be detachably attached to the liquid injection portion. The atmospheric air introducing portion may include a first atmospheric air communication portion and a second atmospheric air communication portion that communicate with the liquid containing portion. The first atmospheric air communication portion may include a first atmospheric air introducing inlet that is open to the liquid containing portion. The second atmospheric air communication portion may include a second atmospheric air introducing inlet that is open to the liquid containing portion. The liquid containing portion may include a first wall portion, a second wall portion that is located opposite to the first wall portion, a third wall portion that is located between the first wall portion and the second wall portion in a direction extending from the first wall portion toward the second wall portion and intersects with the first wall portion and the second wall portion, and a fourth wall portion that is located opposite to the third wall portion and intersects with the first wall portion and the second wall portion. When the tank is in a liquid injecting orientation, which is an orientation when the liquid is injected from the liquid injection portion, the first wall portion is located at a position that is lower than the second wall portion, the third wall portion and the fourth wall portion, the first atmospheric air introducing inlet is located at a position that is closer to the second wall portion than the first wall portion and is closer to the third wall portion than the fourth wall portion, the second atmospheric air introducing inlet is located at a position closer to the first wall portion than the second wall portion and is closer to the fourth wall portion than the third wall portion. With the tank according to this embodiment, even when the tank is disposed in a state rotated from the liquid injecting orientation, a situation is suppressed in which both the first atmospheric air introducing inlet and the second atmospheric air introducing inlet are closed by the liquid contained in the liquid containing portion. Accordingly, a situation is suppressed when the tank is in an orientation rotated from the liquid injecting orientation, the liquid containing portion is hermetically sealed from the outside, and a situation is suppressed in which the liquid contained in the liquid containing portion is forced to the outside due to the expansion of the air contained in the liquid containing portion.

[4] In the tank according to any one of the embodiments described above, the atmospheric air introducing portion may further include a third atmospheric air communication portion that communicates with the liquid containing portion. The third atmospheric air communication portion may include a third atmospheric air introducing inlet that is open to the liquid containing portion. In a state in which the liquid containing portion contains the air and the liquid in an amount equal to ⅔ of a capacity of the liquid of the liquid containing portion, when the tank is in an orientation in which the first atmospheric air introducing inlet and the second atmospheric air introducing inlet are located in a region where the liquid is present, the third atmospheric air introducing inlet may be located in a region where the air is present. With the tank according to this embodiment, as a result of having the third atmospheric air introducing inlet, even if the first atmospheric air introducing inlet and the second atmospheric air introducing inlet are closed by the liquid, a situation is suppressed in which the admission of atmospheric air into the liquid containing portion is blocked. Accordingly, a situation is further suppressed in which the liquid is forced to the outside due to the expansion of the air contained in the liquid containing portion.

[5] In the tank according to any one of the embodiments described above, the atmospheric air introducing portion further may include a third atmospheric air communication portion that communicates with the liquid containing portion, the third atmospheric air communication portion may include a third atmospheric air introducing inlet that is open to the liquid containing portion, the third atmospheric air introducing inlet may be located at a position that is closer to the first wall portion than the first atmospheric air introducing inlet and is closer to the third wall portion than the second atmospheric air introducing inlet. With the tank according to this embodiment, as a result of having the third atmospheric air introducing inlet, even if the first atmospheric air introducing inlet and the second atmospheric air introducing inlet are closed by the liquid, a situation is suppressed in which the admission of atmospheric air into the liquid containing portion is blocked. Accordingly, a situation is further suppressed in which the liquid is forced to the outside due to the expansion of the air contained in the liquid containing portion.

[6] In the tank according to any one of the embodiments described above, the atmospheric air introducing portion may further include a third atmospheric air communication portion that communicates with the liquid containing portion, the third atmospheric air communication portion may include a third atmospheric air introducing inlet that is open to the liquid containing portion, and the third atmospheric air introducing inlet may be located at a position closer to the fourth wall portion than the first atmospheric air introducing inlet and is closer to the second wall portion than the second atmospheric air introducing inlet. With the tank according to this embodiment, as a result of having the third atmospheric air introducing inlet, even if the first atmospheric air introducing inlet and the second atmospheric air introducing inlet are closed by the liquid, a situation is suppressed in which the admission of atmospheric air into the liquid containing portion is blocked. Accordingly, a situation is further suppressed in which the liquid is forced to the outside due to the expansion of the air contained in the liquid containing portion.

[7] In the tank according to any one of the embodiments described above, the liquid containing portion may further include a fifth wall portion that intersects with the first wall portion, the second wall portion, the third wall portion and the fourth wall portion, and a sixth wall portion that is located opposite to the fifth wall portion and intersects with the first wall portion, the second wall portion, the third wall portion and the fourth wall portion. The first wall portion, the second wall portion, the third wall portion, the fourth wall portion and the fifth wall portion may be constituted by wall portions of an integrally molded housing member, and the sixth wall portion may be constituted by a film-like member that is bonded to the housing member. With the tank according to this embodiment, it is possible to achieve simplification of the configuration, weight reduction and cost reduction of the tank and facilitation of production.

[8] In the tank according to any one of the embodiments described above, the liquid containing portion may further include a fifth wall portion that intersects with the first wall portion, the second wall portion, the third wall portion and the fourth wall portion, and a sixth wall portion that is located opposite to the fifth wall portion and intersects with the first wall portion, the second wall portion, the third wall portion and the fourth wall portion. The first wall portion, the second wall portion, the third wall portion and the fourth wall portion may be constituted by wall portions of an integrally molded housing member, and the fifth wall portion and the sixth wall portion may be constituted by film-like members that are bonded to the housing member. With the tank according to this embodiment, it is possible to achieve simplification of the configuration, weight reduction and cost reduction of the tank and facilitation of production.

[9] In the tank according to any one of the embodiments described above, when the tank is in the liquid injecting orientation, the first atmospheric air communication portion may include a path portion that passes through a position that is lower than a height position between the first wall portion and a midpoint between the first wall portion and the second wall portion, and the second atmospheric air communication portion may include a path portion that passes through a position that is higher than a height position of the midpoint between the first wall portion and the second wall portion. With the tank according to this embodiment, even when the tank is rotated from the liquid injecting orientation, leakage of the liquid from the liquid containing portion is suppressed.

[10] In the tank according to any one of the embodiments described above, the first atmospheric air communication portion may include a first back path portion provided in a back surface of the fifth wall portion that is opposite to the liquid containing portion, and the second atmospheric air communication portion may include a second back path portion provided in the back surface. With the tank according to this embodiment, the degree of freedom in designing the first atmospheric air communication portion and the second atmospheric air communication portion can be enhanced.

[11] In the tank according to any one of the embodiments described above, the first atmospheric air introducing inlet may be provided at a position closer to the fifth wall portion or the sixth wall portion, and the second atmospheric air introducing inlet may be provided at a position closer to the sixth wall portion. With the tank according to this embodiment, a situation is further suppressed in which both the first atmospheric air introducing inlet and the second atmospheric air introducing inlet are closed by the liquid.

[12] In the tank according to any one of the embodiments described above, the second atmospheric air communication portion may include a tubular path portion, which is an atmospheric air path constituted by a tubular member, and the second atmospheric air introducing inlet may be open at an end portion of the tubular path portion disposed in the liquid containing portion. With the tank according to this embodiment, the second atmospheric air communication portion can be simply configured.

[13] The tank according to any one of the embodiments described above may include a common atmospheric air intake portion having an atmospheric air opening that communicates with the first atmospheric air communication portion and the second atmospheric air communication portion and is open to outside so as to be capable of drawing atmospheric air. With the tank according to this embodiment, it is possible to achieve miniaturization and simplification of the configuration.

[14] In the tank according to any one of the embodiments described above, the first atmospheric air communication portion may include a first atmospheric air opening that is open to outside so as to be capable of drawing atmospheric air, and the second atmospheric air communication portion may include a second atmospheric air opening that is open to outside so as to be capable of drawing atmospheric air. With the tank according to this embodiment, atmospheric air can be introduced into the first atmospheric air communication portion and the second atmospheric air communication portion from the separate atmospheric air openings.

[15] In the tank according to any one of the embodiments described above, the liquid injection portion may include a liquid injection inlet that is open to the liquid containing portion and is provided to allow the liquid to flow into the liquid containing portion. When the tank is in the liquid injecting orientation, the first atmospheric air communication portion may include an atmospheric air path that is located at a position that is higher than the liquid injection inlet. With the tank according to this embodiment, even if an excessive amount of liquid is injected into the liquid containing portion, leakage of the liquid via the first atmospheric air communication portion is suppressed.

[16] In the tank according to any one of the embodiments described above, when the tank is in the liquid injecting orientation and the liquid containing portion is filled with the liquid, the liquid injection inlet may be located above the liquid contained in the liquid containing portion. With the tank according to this embodiment, a situation is suppressed in which a large amount of liquid that causes the liquid to overflow from the liquid containing portion is injected into the liquid containing portion.

[17] A third embodiment of the invention provides a tank unit. The tank unit according to this embodiment may include a tank and an outer jacket. The tank may be the tank according to any one of the embodiments described above. The outer jacket may house the tank. The tank may include a visible portion that allows a position of the surface of the liquid contained in the liquid containing portion to be visible. The outer jacket may include a window portion that allows the visible portion of the tank to be visible from the outside. When the tank is in the liquid injecting orientation, the first atmospheric air introducing inlet may be located at a position that is higher than an upper end of the window portion. With the tank unit according to this embodiment, a situation is suppressed in which a large amount of liquid that causes the liquid surface to reach the position of the first atmospheric air introducing inlet is loaded. Accordingly, a situation is suppressed in which both the first atmospheric air introducing inlet and the second atmospheric air introducing inlet are closed by the liquid due to the rotation of the tank unit.

[18] A fourth embodiment of the invention provides a liquid ejection system. The liquid ejection system according to this embodiment may include a tank unit and a liquid ejection apparatus. The tank unit may be the tank unit according to the embodiment described above. The liquid ejection apparatus may include the liquid ejection head, and may be connected to the tank unit. With the liquid ejection system according to this embodiment, leakage of the liquid from the tank is suppressed.

[19] A fifth embodiment of the invention provides a liquid ejection system. The liquid ejection system according to this embodiment may include a tank, the liquid ejection head and an outer jacket. The tank may be the tank according to any one of the embodiments described above. The outer jacket may house the tank and the liquid ejection head. With the liquid ejection system according to this embodiment, leakage of the liquid from the tank is suppressed.

[20] A sixth embodiment of the invention provides a tank. The tank according to this embodiment may be configured so as to be capable of supplying a liquid to a liquid ejection head. The tank may include a liquid containing portion, a liquid supply portion and an atmospheric air introducing portion. The liquid containing portion may be configured so as to be capable of containing the liquid. The liquid supply portion may be configured so as to be capable of supplying the liquid of the liquid containing portion to the liquid ejection head. The atmospheric air introducing portion may be configured so as to be capable of introducing outside atmospheric air to the liquid containing portion. The atmospheric air introducing portion may include a first atmospheric air communication portion and a second atmospheric air communication portion that communicate with the liquid containing portion. The first atmospheric air communication portion may include a first atmospheric air introducing inlet that is open to the liquid containing portion. The second atmospheric air communication portion may include a second atmospheric air introducing inlet that is open to the liquid containing portion. In a state in which the liquid containing portion contains the air and the liquid in an amount occupying ½ of a capacity of the liquid of the liquid containing portion, (i) when the tank is in a liquid supply orientation, which is an orientation when the liquid is supplied to the liquid ejection head used to eject the liquid, the first atmospheric air introducing inlet may be located in a region where the air is present, and the second atmospheric air introducing inlet is located in a region where the liquid is present, and (ii) when the tank is in a reversed orientation rotated upside down by 180° from the liquid supply orientation, the first atmospheric air introducing inlet may be located in a region where the liquid is present, and the second atmospheric air introducing inlet may be located in a region where the air is present. With the tank according to this embodiment, when the tank is in an orientation reversed from the liquid supply orientation, a situation is suppressed in which the second atmospheric air introducing inlet is closed by the liquid together with the first atmospheric air introducing inlet. Accordingly, when the tank is in the reversed orientation, even if the air contained in the liquid containing portion expands, a situation is suppressed in which the liquid contained in the liquid containing portion is forced to the outside due to the expansion of the air contained in the liquid containing portion.

Not all of a plurality of constituent elements of each embodiment of the invention are essential, and in order to solve some or all of the above-described problems or achieve some or all of the effects described in the specification, some of the plurality of constituent elements may be changed, removed or replaced by additional other constituent elements as appropriate, or the content of the limitations may be partially removed as appropriate. Also, in order to solve some or all of the above-described problems or achieve some or all of the effects described in the specification, it is also possible to combine some or all of the technical features included in one embodiment of the invention with some or all of the technical features included in another embodiment of the invention so as to form one independent embodiment of the invention.

The invention can also be implemented as various types of embodiments other than a tank capable of supplying a liquid to a liquid ejection head, a tank unit including the tank, and a liquid ejection system including the tank. For example, the invention can be implemented as a tank capable of supplying a liquid to a liquid consuming apparatus other than a liquid ejection head, or a tank unit including the tank and a system including the tank. In addition thereto, the invention can be implemented as a fluid flow path structure for use in a tank. The term "system" as used in this specification refers to a set of a plurality of constituent elements provided in an integrated or dispersed manner and combined such that their respective functions directly or indirectly interact with each other, so as to implement at least one function. Accordingly, the system as used in this specification also encompasses an "apparatus" in which a plurality of constituent elements are integrally combined.

BRIEF DESCRIPTION OF THE DRAWINGS

The invention will be described with reference to the accompanying drawings, wherein like numbers reference like elements.

DESCRIPTION OF EXEMPLARY EMBODIMENTS

A. First Embodiment

Configuration of Printer

Figure 1:
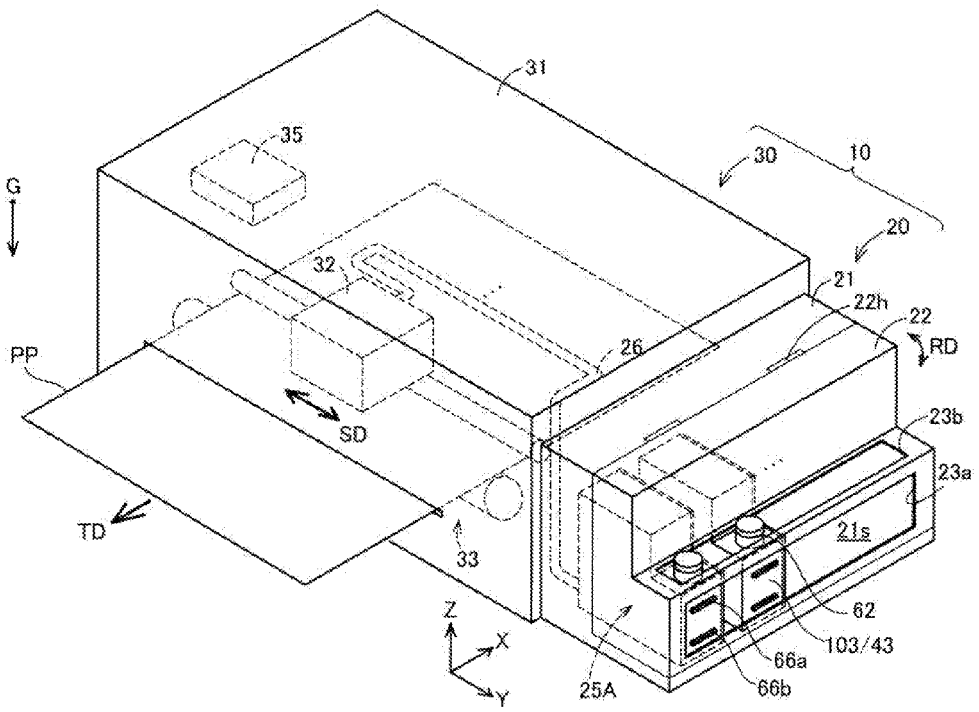
FIG. 1 is a schematic diagram showing a configuration of an inkjet printer.

FIG. 1 is a schematic diagram showing a configuration of an inkjet printer 10 (hereinafter referred to simply as "printer 10") according to a first embodiment of the invention. In FIG. 1, an arrow G indicating the direction of gravity (vertical direction) when the printer 10 is in a normal state of use is shown. In the following description, "up" and "down" refer to the up-down direction in the direction of gravity. Also, in FIG. 1, arrows X, Y and Z indicating three directions that are mutually perpendicular with an ink tank 25A as a reference are shown. The directions indicated by the arrows X, Y and Z will be described later. The arrows G, X, Y and Z are also shown as appropriate in the diagrams which will be referred to in connection with the following description.

The printer 10 is an embodiment of a liquid ejection system, and forms images by discharging ink droplets onto print paper PP, which is a print medium. The printer 10 includes a tank unit 20 and a printing unit 30. In the printer 10 according to the present embodiment, the tank unit 20 and the printing unit 30 are configured as separate units. With this configuration, maintenance can be performed separately on the tank unit 20 and the printing unit 30, and thus ease of maintenance of the printer 10 can be enhanced.

The tank unit 20 includes a casing portion 21, which is an outer jacket, a plurality of ink tanks 25A and a plurality of tubes 26. The casing portion 21 corresponds to a subordinate concept of the outer jacket of the invention. In the present embodiment, the casing portion 21 is configured as a hollow box made of resin. In an internal space 21*s* of the casing portion 21, the plurality of ink tanks 25A are linearly aligned in a direction indicated by the arrow X, which will be described later, and are fixed. The casing portion 21 is fixed to a casing portion 31 of the printing unit 30 by an engagement mechanism or screwing (illustration omitted).

The casing portion 21 includes a lid portion 22. The lid portion 22 is connected to the main body of the casing portion 21 by a hinge mechanism 22*h*, and is configured to be opened and closed by being swung in a direction indicated by an arrow RD. The user of the printer 10 can access the ink tanks 25A located inside the tank unit by opening the lid portion 22.

In the lid portion 22, a first window portion 23*a* and a second window portion 23*b* are provided. The first window portion 23*a* is an opening for allowing visible portions (described later) respectively provided in the ink tanks 25A to be visible from the outside. The second window portion 23*b* is an opening for allowing access to ink injection portions (described later) respectively provided in the ink tanks 25A from the outside. A detailed description of the window portions 23*a* and 23*b* will be given later.

The ink tank 25A corresponds to a subordinate concept of the tank of the invention. The ink tanks 25A contain inks of mutually different colors. The inks contained in the ink tanks 25A are supplied to the printing unit 30 via the flexible resin tubes 26 connected to the ink tanks 25A in a one-to-one correspondence. A description of a configuration of the ink tanks 25A will be given later. In addition thereto, the tank unit 20 may be provided with an electric circuit and wiring for exchanging electric signals representing ink information such as the remaining amounts of ink in the ink tanks 25A with the printing unit 30.

The printing unit 30 includes the casing portion 31, a print head portion 32, a conveyance mechanism 33 for conveying the print paper PP, and a control portion 35. The casing portion 31 serves as the outer jacket of the printing unit 30, and is configured as a hollow box made of resin. The casing portion 31 houses therein the print head portion 32, the conveyance mechanism 33 and the control portion 35.

The print head portion 32 is installed so as to be capable of reciprocal movement in a main scanning direction SD on a conveyance path along which the print paper PP is conveyed. The print head portion 32 is connected to the ink tanks 25A of the tank unit 20 via the above-described tubes 26, and is capable of discharging inks supplied from the ink tanks 25A. The print head portion 32 corresponds to a subordinate concept of the liquid ejection head of the invention. The conveyance mechanism 33 is capable of conveying the print paper PP in a conveyance direction TD that intersects with the main scanning direction SD by rotary driving of conveyance rollers.

The control portion 35 is implemented by, for example, a microcomputer including a central processing unit and a main storage device. The control portion 35 provides various functions by the central processing unit reading various programs into the main storage device and executing the programs. At the time of printing, under control of the control portion 35, the conveyance mechanism 33 conveys the print paper PP, and the print head portion 32 discharges ink droplets while reciprocally moving in the main scanning direction SD, whereby a print image is formed on the print surface of the print paper PP.

Configuration of Ink Tank

Figure 2:
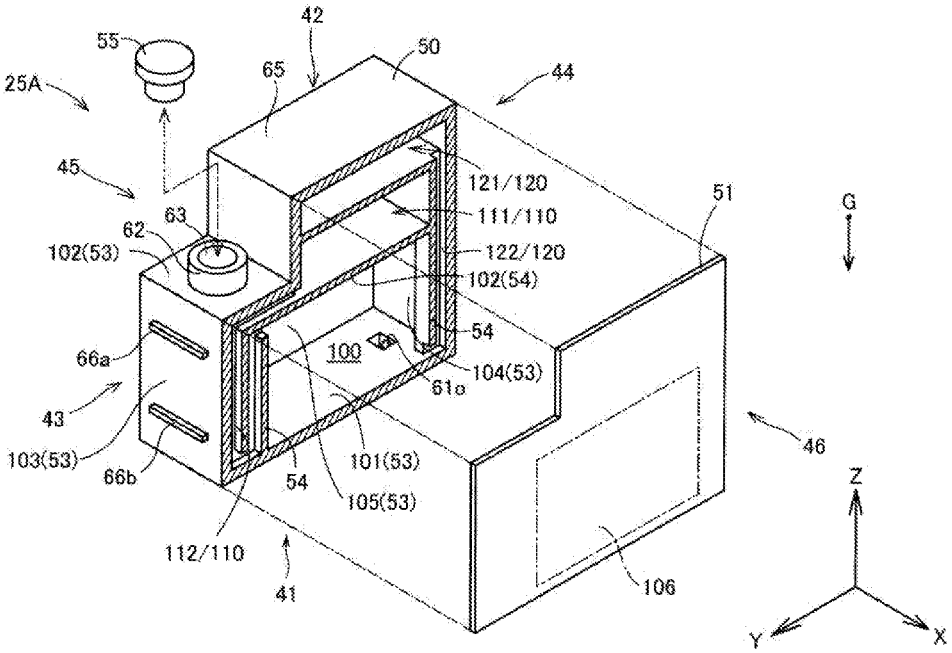
FIG. 2 is a schematic exploded perspective view of an ink tank according to a first embodiment.
Figure 3:
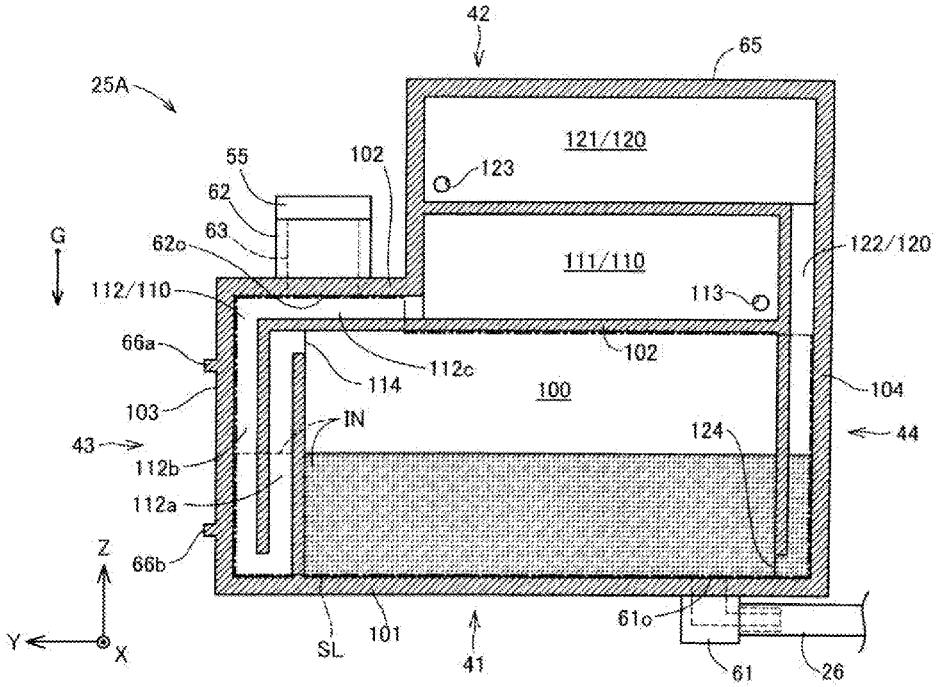
FIG. 3 is a schematic cross-sectional view of the ink tank according to the first embodiment.

A configuration of the ink tanks 25A will be described with reference to FIGS. 2 and 3, in addition to FIG. 1. FIG. 2 is a schematic exploded perspective view of an ink tank 25A. FIG. 3 is a schematic cross-sectional view of the ink tank 25A as viewed from a bonding face between a case member 50 and a sheet member 51. FIG. 3 shows an example of a state in which ink IN is stored in an ink containing portion 100 in an amount occupying ½ of the volume of the ink containing portion 100. In FIG. 3, outer contour SL of the ink containing portion 100 as viewed in a direction opposite to the direction of the arrow X is indicated by a dash dot line.

The ink tank 25A is configured as a hollow container including six surfaces 41 to 46. The six surfaces 41 to 46 will be described by using an orientation (FIG. 1) when the ink tank 25A is fixed within the tank unit 20 connected to the printer 10 that is in a normal state of use, as the reference. Hereinafter, this orientation will be referred to as "reference orientation". In the present embodiment, the reference orientation is an orientation used when ink is injected into the ink tank 25A by the user, and is also an orientation used when ink is supplied to the print head portion 32 so as to discharge ink droplets. The reference orientation corresponds to a subordinate concept of the liquid injecting orientation of the invention, and also corresponds to a subordinate concept of the liquid supply orientation of the invention. In the following description, unless otherwise stated, the ink tank 25A is in the reference orientation.

In the ink tank 25A, a first surface 41 is located at a position that is lower than the other surfaces 42 to 45, and constitutes the bottom surface that faces downward (FIG. 2). A second surface 42 is located opposite to the first surface 41, and constitutes the upper surface that faces upward. A third surface 43 intersects with the first surface 41 and the second surface 42, and constitutes the front surface that faces toward the user when the lid portion 22 of the casing portion 21 of the tank unit 20 is opened. A fourth surface 44 intersects with the first surface 41 and the second surface 42, and constitutes the rear surface that faces in a direction opposite to the third surface 43. A fifth surface 45 intersects with each of the four surfaces 41 to 44, and constitutes the left side surface that is located on the left as viewed from directly in front of the third surface 43. A sixth surface 46 intersects with each of the four surfaces 41 to 44, and constitutes the right side surface that is located on the right, which is the opposite side of the fifth surface 45, as viewed from directly in front of the third surface 43.

In this specification, "surface" does not necessarily need to be planar, and may be curved, and may have a recess, a protrusion, a step, a groove, a bent portion, an inclined surface or the like. Likewise, "intersect" used to indicate that two surfaces intersect with each other refers to one of the following states: a state in which two surfaces actually intersect with each other; a state in which an extended surface of one surface intersects with the other surface; and a state in which extended surfaces of two surfaces intersect with each other. Accordingly, a chamfer constituting a curved surface or the like may be present between adjacent surfaces.

Next is a description of the arrows X, Y and Z indicating three directions with the ink tank 25A as a reference. The arrow X indicates a direction parallel to a width direction (right-left direction) of ink tank 25, the direction extending from the fifth surface 45 toward the sixth surface 46. In the following description, "right" refers to the side in the direction of the arrow X, and "left" refers to the side in a direction opposite to the direction of the arrow X. The arrow Y indicates a direction parallel to a depth direction (front-rear direction) of the ink tank 25A, the direction extending from the fourth surface 44 toward the third surface 43. In the following description, "front" refers to the side in the direction of the arrow Y, and "rear" refers to the side in a direction opposite to the direction of the arrow Y. The arrow Z indicates a height direction (up-down direction) of the ink tank 25, and the direction extending from the first surface 41 toward the second surface 42. In the reference orientation, a direction opposite to the direction of the arrow Z matches the direction of gravity (vertical direction).

The ink tank 25A includes the case member 50 and the sheet member 51 (FIG. 2). The case member 50 is a hollow box constituting the main body of the ink tank 25A. The case member 50 corresponds to a subordinate concept of the housing member of the invention. The case member 50 has an opening that is almost entirely open to the direction of the arrow X on the sixth surface 46 side, and outer wall portions 53 surrounding an internal space of the case member 50 respectively constitute five surfaces 41 to 45 excluding the sixth surface 46. The case member 50 is produced by, for example, integral molding using synthetic resin such as nylon or polypropylene.

The sheet member 51 is a flexible member in the form of a thin film, which is bonded so as to seal the entire opening of the case member 50 formed on the sixth surface 46 side and constitutes the sixth surface 46 of the ink tank 25. In FIGS. 2 and 3, in the case member 50, the regions to which the sheet member 51 is to be bonded are indicated by hatching. The sheet member 51 is implemented by, for example, a film member made of synthetic resin such as nylon or polypropylene. The sheet member 51 is bonded to the case member 50 by, for example, welding. The sheet member 51 corresponds to a subordinate concept of the film-like member of the invention. Due to the case member 50 and the sheet member 51, the ink tank 25A of the present embodiment is configured to be simple and lightweight. A wall portion constituting the fifth surface 45 may also be constituted by a sheet member 51, as with the sixth surface 46.

An internal space of the ink tank 25A formed between the case member 50 and the sheet member 51 is partitioned into a plurality of regions by inner wall portions 54 of the case member 50 (FIGS. 2 and 3). As a result of being partitioned by the inner wall portions 54, in the inside of the ink tank 25A, the ink containing portion 100, a first atmospheric air introducing portion 110 and a second atmospheric air introducing portion 120 are formed.

The ink containing portion 100 is a hollow part capable of containing the ink IN. The first atmospheric air introducing portion 110 and the second atmospheric air introducing portion 120 are parts that function as an air flow path that communicates between the outside and the ink containing portion 100 so as to introduce outside atmospheric air into the ink containing portion 100 (FIG. 3). A detailed description of the ink containing portion 100 and the two atmospheric air introducing portions 110 and 120 will be given later.

An ink supply portion 61 is provided on the first surface 41 of the case member 50 (FIG. 3). The ink supply portion 61 is a part having a flow path that communicates with the ink containing portion 100 so as to allow the ink of the ink containing portion 100 to flow out of the ink containing portion 100. In the present embodiment, the ink supply portion 61 is configured as a hollow part protruding downward in the first surface 41. The above-described tube 26 is hermetically connected to the ink supply portion 61 in a direction of attachment, which is the direction of the arrow Y. However, the ink supply portion 61 may be configured such that the tube 26 is attached from a direction other than the direction of the arrow Y.

The second surface 42 of the case member 50 includes an ink injection portion 62 and an atmospheric air chamber housing portion 65 (FIGS. 2 and 3). The ink injection portion 62 is provided on the third surface 43 side, and the atmospheric air chamber housing portion 65 is provided on the fourth surface 44 side. The ink injection portion 62 is a part that communicates with the ink containing portion 100 so that the user can inject the ink IN. In the present embodiment, the ink injection portion 62 is configured as a cylindrical part protruding upward, and has a through hole 63 that communicates with the ink containing portion 100.

The ink injection portion 62 corresponds to a subordinate concept of the liquid injection portion of the invention.

In the tank unit 20, an upper end of the ink injection portion 62 extends upward via the second window portion 23*b* of the casing portion 21 (FIG. 1). Usually, a cap member 55 for sealing the through hole 63 is detachably attached to the upper end of the ink injection portion 62 (FIGS. 2 and 3). The user can load an ink into the ink tank 25A via the ink injection portion 62 by removing the cap member 55. The cap member 55 corresponds to a subordinate concept of the sealing member of the invention.

The atmospheric air chamber housing portion 65 is a hollow part having a substantially rectangular parallelepiped shape protruding in a stepwise configuration on the rear side of the ink injection portion 62 (FIGS. 2 and 3). In the inside of the atmospheric air chamber housing portion 65, a first atmospheric air chamber 111 (described later) of the first atmospheric air introducing portion 110 and a second atmospheric air chamber 121 (described later) of the second atmospheric air introducing portion 120 are provided.

In addition thereto, in the ink tank 25A according to the present embodiment, a wall surface of an outer wall portion 53 constituting the third surface 43 is provided with two mark portions 66*a* and 66*b* for respectively indicating the upper and lower limit positions of the surface of the ink IN. A detailed description of the mark portions 66*a* and 66*b* will be given later.

Configuration of Ink Containing Portion

The ink containing portion 100 corresponds to a subordinate concept of the liquid containing portion of the invention. In the present embodiment, the ink containing portion 100 is formed in the lowermost region so as to extend substantially over the width direction and the front-rear direction of the ink tank 25 (FIGS. 2 and 3). The ink containing portion 100 is surrounded by six wall portions 101 to 106.

A first wall portion 101 is located at a position that is lower than the other wall portions 102 to 106, and constitutes the bottom wall portion of the ink containing portion 100. In the present embodiment, the first wall portion 101 is constituted by an outer wall portion 53 constituting the first surface 41 of the ink tank 25A. In the first wall portion 101, an ink supply inlet 61*o* that communicates with the ink supply portion 61 is formed.

A second wall portion 102 is located opposite to the first wall portion 101, and constitutes the upper wall portion of the ink containing portion 100. In the present embodiment, the second wall portion 102 is constituted by an outer wall portion 53 constituting the second surface 42 of the ink tank 25A and an inner wall portion 54 that provides a partition between the ink containing portion 100 and the first atmospheric air chamber 111.

In the second wall portion 102, an ink injection inlet 62*o* is formed in an area where the ink containing portion 100 and the through hole 63 of the ink injection portion 62 intersect with each other. In the present embodiment, the ink injection inlet 62*o* is provided at the highest position in the ink containing portion 100 so as to be open downwardly. The ink injection inlet 62*o* is located above the ink IN contained in the ink containing portion 100 even when the ink containing portion 100 is filled with the ink IN and completely full. With this configuration, a situation is suppressed in which a large amount of ink IN that causes the ink to overflow from the ink containing portion 100 is injected from the ink injection portion 62.

A third wall portion 103 intersects with the first wall portion 101 and the second wall portion 102, and constitutes one of the side wall portions of the ink containing portion 100. In the present embodiment, the third wall portion 103 is constituted by an outer wall portion 53 constituting the third surface 43 of the ink tank 25A. In the present embodiment, the third wall portion 103 functions as the visible portion for allowing the amount of ink IN contained in the ink containing portion 100 to be visible from the outside. A detailed description of the visible portion will be given after a description of the atmospheric air introducing portions 110 and 120.

A fourth wall portion 104 is located opposite to the third wall portion 103, intersects with the first wall portion 101 and the second wall portion 102, and constitutes one of the side wall portions of the ink containing portion 100. In the present embodiment, the fourth wall portion 104 is constituted by an outer wall portion 53 constituting the fourth surface 44 of the ink tank 25A.

A fifth wall portion 105 intersects with the first wall portion 101, the second wall portion 102, the third wall portion 103 and the fourth wall portion 104, and constitutes one of the side wall portions of the ink containing portion 100. In the present embodiment, the fifth wall portion 105 is constituted by an outer wall portion 53 constituting the fifth surface 45 of the ink tank 25A.

A sixth wall portion 106 is located opposite to the fifth wall portion 105, intersects with the first wall portion 101, the second wall portion 102, the third wall portion 103 and the fourth wall portion 104, and constitutes one of the side wall portions of the ink containing portion 100. In the present embodiment, the sixth wall portion 106 is constituted by the sheet member 51 constituting the sixth surface 46 of the ink tank 25A and an inner wall portion 54 having a first atmospheric air communication path 112 (described later) and a second atmospheric air communication path 122 (described later) formed therein.

Overview of Atmospheric Air Introducing Portion

The ink tank 25A includes two atmospheric air introducing portions 110 and 120. The atmospheric air introducing portions 110 and 120 correspond to a subordinate concept of the atmospheric air introducing portion of the invention, and a part having a structure that communicates between the ink containing portion 100 and the outside of the ink tank 25A. The atmospheric air introducing portions 110 and 120 function as an air flow path for allowing atmospheric air to flow into the ink containing portion 100 such that the air pressure within the ink containing portion 100 is equal to or closer to the atmospheric pressure.

In the atmospheric air introducing portions 110 and 120, it is desirable that, in order to suppress evaporation of the liquid from the ink containing portion 100, the flow path diameter and the flow path distance are set so as to have a predetermined range of flow path resistance. It is preferable that the flow path resistance of the atmospheric air introducing portions 110 and 120 is set to be higher than the flow path resistance of the ink containing portion 100. Hereinafter, the configurations of the two atmospheric air introducing portions 110 and 120 according to the present embodiment will be described in detail in order.

Configuration of First Atmospheric Air Introducing Portion

The first atmospheric air introducing portion 110 includes a first atmospheric air chamber 111 and a first atmospheric air communication path 112. The first atmospheric air chamber 111 is a hollow part capable of containing atmospheric air drawn from the outside. Likewise, the first atmospheric air chamber 111 is configured so as to be capable of storing an ink that has flowed from the ink containing portion 100

(described later). In the present embodiment, the first atmospheric air chamber 111 is formed in an upper area of the ink containing portion 100 so as to extend substantially over the width direction of the ink tank 25A.

The first atmospheric air chamber 111 is provided with a first atmospheric air intake inlet 113, which is a through hole that communicates with the outside. It is desirable that the first atmospheric air intake inlet 113 is provided at a position closer to the lower end of the first atmospheric air chamber 111. Also, it is desirable that the first atmospheric air intake inlet 113 is provided at a position closer to the fourth surface 44 side. The reason will be described later. The first atmospheric air intake inlet 113 corresponds to a subordinate concept of the first atmospheric air opening of the invention.

The first atmospheric air communication path 112 is a tubular path that communicates between the first atmospheric air chamber 111 and the ink containing portion 100. The first atmospheric air communication path 112 corresponds to a subordinate concept of the first atmospheric air communication portion of the invention. In the present embodiment, the first atmospheric air communication path 112 is constituted by a groove provided on a surface, which is opposite to the sheet member 51, of the inner wall portion 54 protruding toward the inside of the ink containing portion 100 along the surface of the sheet member 51 on the third surface 43 side of the ink tank 25A. The first atmospheric air communication path 112 includes a first path portion 112*a*, a second path portion 112*b* and a third path portion 112*c*.

The first path portion 112*a* and the second path portion 112*b* are paths extending in parallel to each other along the direction of the arrow Z at an end portion on the third wall portion 103 side of the ink containing portion 100. The first path portion 112*a* is provided on a side opposite to the second path portion 112*b* in a direction opposite to the direction of the arrow Y, and is connected to the ink containing portion 100 in an upper region of the ink containing portion 100. A first atmospheric air introducing inlet 114 is formed in an area where the first path portion 112*a* and the ink containing portion 100 intersect with each other.

It is desirable that, in the reference orientation, the first atmospheric air introducing inlet 114 is provided at a position that suppresses the flow of the ink IN contained in the ink containing portion 100 thereinto. For this reason, it is desirable that the first atmospheric air introducing inlet 114 is located in a region between the second wall portion 102 and a midpoint between the second wall portion 102 and the first wall portion 101. Also, it is desirable that when the ink tank 25A is in the reference orientation and the ink IN is contained in the ink containing portion 100 in an amount occupying ½ of the ink capacity of the ink containing portion 100, the first atmospheric air introducing inlet 114 is located in a region where the air is present. The term "the ink capacity of the ink containing portion 100" refers to an amount corresponding to the volume of the ink containing portion 100.

The first path portion 112*a* extends from the first atmospheric air introducing inlet 114 to a height position of the first wall portion 101 of the ink containing portion 100, and is connected to the second path portion 112*b*. The second path portion 112*b* extends in the direction of the arrow Z from a height position of the lower end of the ink containing portion 100 to a height position of the lower end of the first atmospheric air chamber 111. The third path portion 112*c* is connected to the second path portion 112*b* at the upper end of the second path portion 112*b*, extends in a direction opposite to the direction of the arrow Y, and is connected to the lower end of the first atmospheric air chamber 111.

When the ink IN contained in the ink containing portion 100 is supplied to the print head portion 32 (FIG. 1) of the printer 10 via the ink supply portion 61 and consumed, the ink containing portion 100 is negatively pressurized. In response thereto, outside atmospheric air is introduced into the ink containing portion 100 via the first atmospheric air chamber 111 and the first atmospheric air communication path 112 of the first atmospheric air introducing portion 110. Also, in the ink tank 25A, due to the presence of the first atmospheric air chamber 111 and the first atmospheric air communication path 112, the air flow path distance is elongated, and thus evaporation of the ink IN contained in the ink containing portion 100 to the outside via the first atmospheric air intake inlet 113 is suppressed.

Configuration of Second Atmospheric Air Introducing Portion

The second atmospheric air introducing portion 120 includes a second atmospheric air chamber 121 and a second atmospheric air communication path 122. The second atmospheric air chamber 121 is a hollow part capable of containing atmospheric air drawn from the outside. Also, the second atmospheric air chamber 121 is configured so as to be capable of storing the ink IN that has flowed from the ink containing portion 100 (described later). In the present embodiment, the second atmospheric air chamber 121 is formed above the first atmospheric air chamber 111 so as to extend substantially over the width direction of the ink tank 25A.

The second atmospheric air chamber 121 is provided with a second atmospheric air intake inlet 123, which is a through hole that communicates with the outside. It is desirable that the second atmospheric air intake inlet 123 is provided at a position closer to the lower end of the second atmospheric air chamber 121. Also, it is desirable that the second atmospheric air intake inlet 123 is provided at a position closer to the third surface 43 side. The reason will be described later. The second atmospheric air intake inlet 123 corresponds to a subordinate concept of the second atmospheric air opening of the invention.

The second atmospheric air communication path 122 is a tubular path that communicates between the second atmospheric air chamber 121 and the ink containing portion 100. The second atmospheric air communication path 122 corresponds to a subordinate concept of the second atmospheric air communication portion of the invention. In the present embodiment, the second atmospheric air communication path 122 is constituted by a groove provided on a surface, which is opposite to the sheet member 51, of the inner wall portion 54 protruding toward the inside of the ink containing portion 100 along the surface of the sheet member 51 on the fourth surface 44 side of the ink tank 25A.

At an end on the fourth surface 44 side of the ink tank 25A, the second atmospheric air communication path 122 extends in the direction of the arrow Z from the lower end of the ink containing portion 100, and is connected to the lower end of the second atmospheric air chamber 121. A second atmospheric air introducing inlet 124 is formed in an area where the second atmospheric air communication path 122 and the ink containing portion 100 intersect with each other.

In the present embodiment, the second atmospheric air introducing inlet 124 is located in a region between the first wall portion 101 and a midpoint between the first wall portion 101 and the second wall portion 102. In a state in which the ink containing portion 100 contains the ink IN in an amount equal to ½ of its ink capacity, when the ink tank 25A is in the reference orientation, the second atmospheric air introducing inlet 124 is located in a region where the ink IN is present. In this state, quite a large amount of ink IN flows into the second atmospheric air communication path 122 through the second atmospheric air introducing inlet 124.

In the state in which the ink containing portion 100 contains the ink IN in an amount equal to ½ of its ink capacity, when the ink tank 25A is rotated upside down by 180° from the reference orientation, the second atmospheric air introducing inlet 124 is located in a region where the ink IN is not present. Hereinafter, this orientation will be referred to as "reversed orientation". Also, in the following description, 180° rotation means to turn upside down.

The ink tank 25A containing the ink IN may be rotated and oriented at various angles from the reference orientation when, for example, the printer 10 is transported. With the ink tank 25A according to the present embodiment, as a result of having the above-described configuration, even when it is brought into an orientation rotated from the reference orientation, leakage of the ink IN to the outside is suppressed as described below. The mechanism of suppressing leakage of the ink IN in the ink tank 25A will be described later.

Ink Tank and Visible Portion of Tank Unit

In the ink tank 25A according to the present embodiment, the third wall portion 103 of the ink containing portion 100 is partially or entirely configured to be transparent or translucent so as to allow the user to view the position of the surface of the ink IN contained in the ink containing portion 100 from the outside. With this configuration, the third wall portion 103 of the ink containing portion 100 functions as the visible portion for allowing the amount of ink IN contained in the ink containing portion 100 to be visible.

The wall surface of the third wall portion 103 is provided with a first mark portion 66*a* and a second mark portion 66*b*. The first mark portion 66*a* indicates the position of the surface of the ink IN when the ink IN is contained in an amount equal to the upper limit amount defined for the ink tank 25A when it is in the reference orientation. It is desirable that the first mark portion 66*a* is formed at a height position lower than the first atmospheric air introducing inlet 114. With this configuration, a situation is suppressed in which an excessive amount of ink IN that causes the ink IN to flow into the first atmospheric air introducing portion 110 is injected into the ink containing portion 100.

The second mark portion 66*b* indicates the position of the surface of the ink IN when the ink IN is contained in an amount equal to the lower limit amount defined for the ink tank 25A when it is in the reference orientation. The mark portions 66*a* and 66*b* may be formed as, for example, protrusions or recesses on the wall surface of the third wall portion 103, or may be formed by printing or attaching a label.

In the casing portion 21 of the tank unit 20, a first window portion 23*a* is provided so that the third wall portion 103 of each ink tank 25A housed in the tank unit 20 can be viewed from the outside (FIG. 1). In the tank unit 20, the first window portion 23*a* functions as the visible portion for allowing the amount of ink contained in each ink tank 25A to be visible.

The first window portion 23*a* of the casing portion 21 of the tank unit 20 is open so as to allow the mark portions 66*a* and 66*b* of the ink tank 25A housed in the tank unit 20 to be visible from the outside. It is desirable that the upper end of the first window portion 23*a* is located at a position that is lower than a height position of the first atmospheric air introducing inlet 114 of the ink tank 25A housed in the tank unit 20. With this configuration, a situation is suppressed in which an excessive amount of ink IN that causes the ink IN to flow into the first atmospheric air introducing portion 110 is injected into the ink containing portion 100 by the user.

Mechanism for Suppressing Leakage of Ink from Ink Tank

Figure 4A:
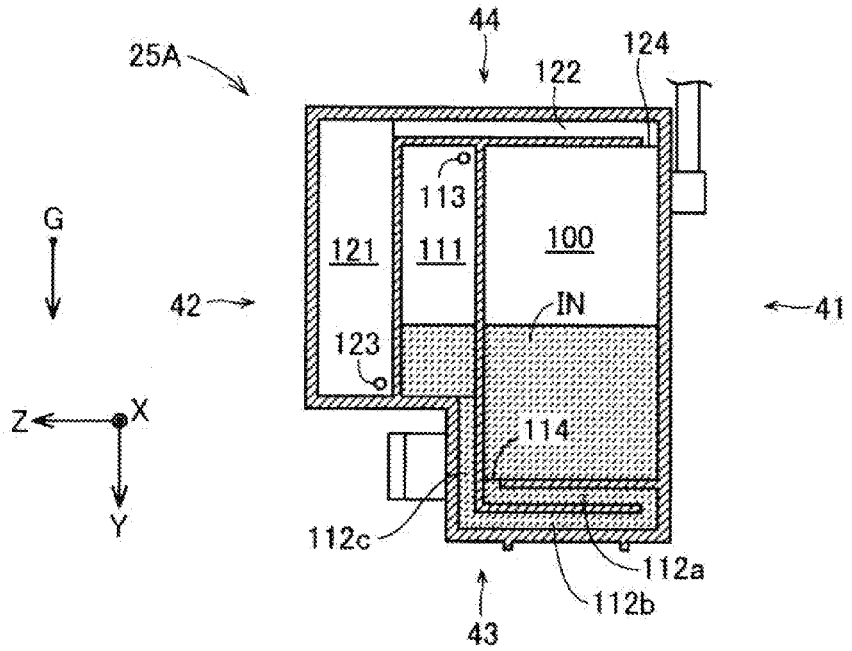
FIGS. 4A and 4B are schematic diagrams illustrating the states of the ink tank according to the first embodiment when it is rotated in a first rotation direction.
Figure 4B:
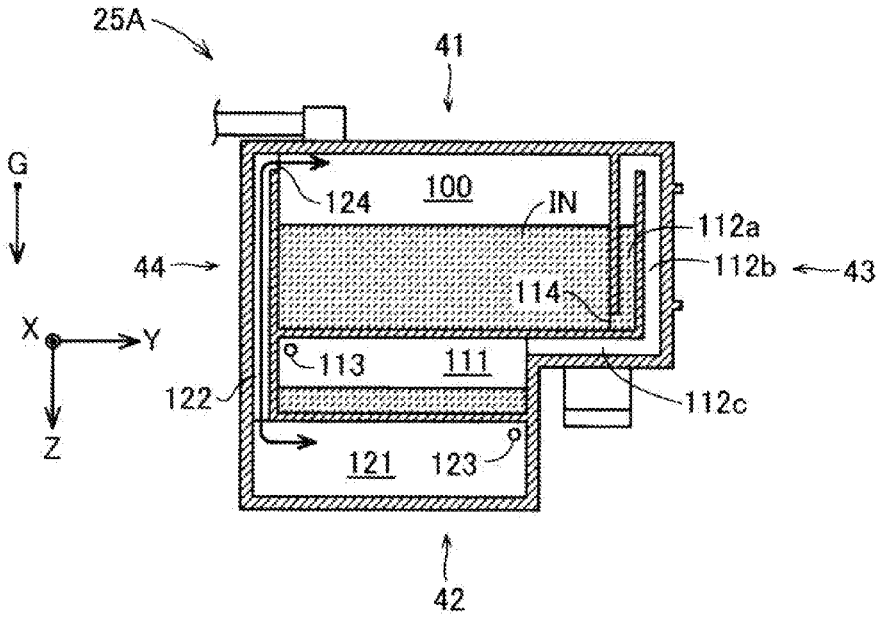

The mechanism of suppressing leakage of the ink IN to the outside when the ink tank 25A is rotated from the reference orientation will be described by making reference to FIGS. 4 and 5 in sequence. FIGS. 4A and 4B schematically illustrate behaviors of the ink contained in the ink tank 25A when the ink tank 25A containing the ink IN is rotated from the reference orientation in a counterclockwise direction as viewed from a direction opposite to the direction of the arrow X. As used herein, "as viewed from a direction opposite to the direction of the arrow X" means to view planarly in a direction from the sixth wall portion 106 toward the fifth wall portion 105. FIG. 4A illustrates the ink tank 25A when it is rotated by 90°, and FIG. 4B illustrates the ink tank 25A when it is rotated by 180°. Hereinafter, the rotation direction of the ink tank 25A shown in FIGS. 4A and 4B will also be referred to as "first rotation direction".

In response to the ink tank 25A being rotated by 90° in the first rotation direction, the first atmospheric air introducing inlet 114 is moved downward, and the ink IN flows into the first atmospheric air communication path 112 (FIG. 4A). Hereinafter, this orientation will also be referred to as "90° rotated orientation toward the left". In the 90° rotated orientation toward the left, the ink IN contained in the ink tank 25A is stored in a region on the third surface 43 side of the first atmospheric air chamber 111. Because the first atmospheric air intake inlet 113 is located at a position closer to the fourth surface 44 side, in this orientation, the first atmospheric air intake inlet 113 is located in an upper region of the first atmospheric air chamber 111. Accordingly, leakage of the ink IN to the outside via the first atmospheric air intake inlet 113 is suppressed.

In response to the ink tank 25A being further rotated in the first rotation direction and brought into the reversed orientation, the ink IN that has flowed into the second path portion 112*b* of the first atmospheric air communication path 112 is stored in a region on the second surface 42 side of the first atmospheric air chamber 111 (FIG. 4B). Because the first atmospheric air intake inlet 113 is located at a position closer to the first surface 41 side in the first atmospheric air chamber 111, in this orientation, the first atmospheric air intake inlet 113 is located in an upper region of the first atmospheric air chamber 111. Accordingly, leakage of the ink IN to the outside via the first atmospheric air intake inlet 113 is suppressed. It is desirable that the first atmospheric air chamber 111 has at least a volume larger than that of the first atmospheric air communication path 112 so as to be capable of storing therein the ink IN that has flowed into the first atmospheric air communication path 112 during the time period during which the ink tank 25A is brought into the reversed orientation from the reference orientation.

The first path portion 112*a* of the first atmospheric air communication path 112 and the second atmospheric air communication path 122 have a path part located at a height position between the first wall portion 101 of the ink containing portion 100 and a midpoint between the first wall portion 101 and the second wall portion 102. Accordingly, when the ink tank 25A is in the reversed orientation, a situation is suppressed in which the ink IN contained in the ink containing portion 100 flows, under the action of gravity, into the first atmospheric air chamber 111 and the second atmospheric air chamber 121 via the first atmospheric air communication path 112 and the second atmospheric air communication path 122.

In the 90° rotated orientation toward the left and the reversed orientation, the second atmospheric air introducing inlet 124 is located in an upper region of the ink containing portion 100 where the air is present, and thus an air flow path to the ink containing portion 100 is ensured by the second atmospheric air introducing portion 120 (FIGS. 4A and 4B). For this reason, in the 90° rotated orientation toward the left and the reversed orientation, even when the air contained in the ink containing portion 100 expands as a result of an increase in the external temperature of the ink tank 25A or a reduction in the air pressure, the expanded air can flow to the outside via the second atmospheric air introducing portion 120. Accordingly, a situation is suppressed in which due to the expansion of the air contained in the ink containing portion 100, the ink IN contained in the ink containing portion 100 is forced into the first atmospheric air introducing portion 110 and leaks to the outside via the first atmospheric air introducing portion 110.

Figure 5A:
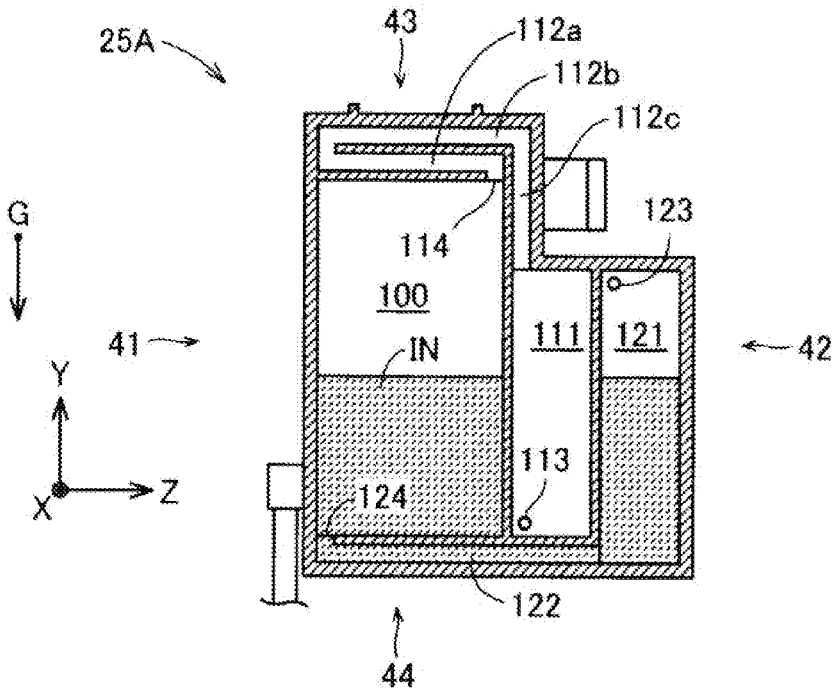
FIGS. 5A and 5B are schematic diagrams illustrating the states of the ink tank according to the first embodiment when it is rotated in a second rotation direction.
Figure 5B:
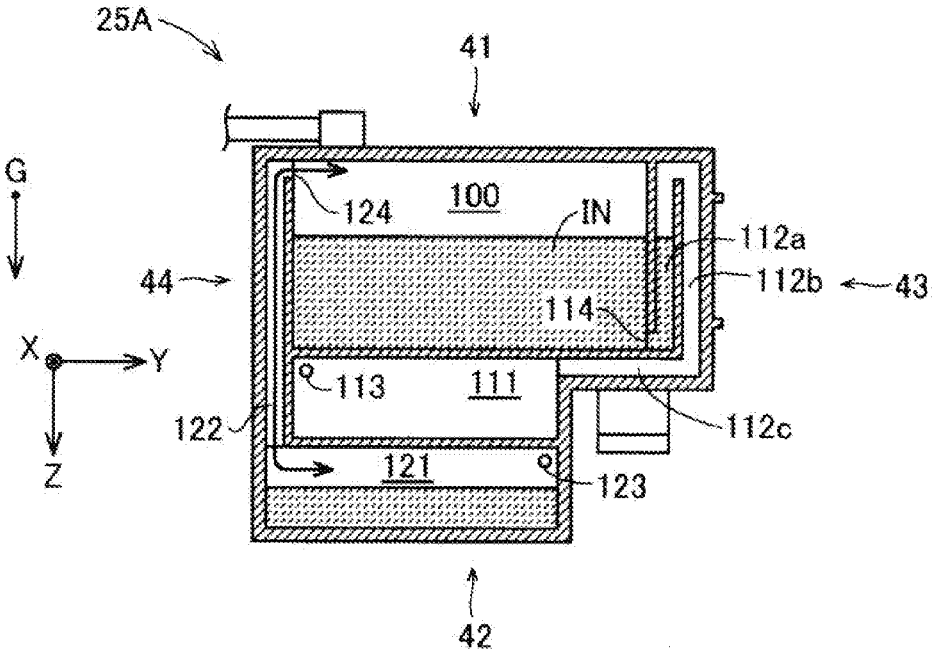

FIGS. 5A and 5B schematically illustrate behaviors of the ink contained in the ink tank 25A when the ink tank 25A containing the ink IN is rotated from the reference orientation in a clockwise direction as viewed from the direction of the arrow X. FIG. 5A illustrates the ink tank 25A when it is rotated by 90° from the reference orientation, and FIG. 5B illustrates the ink tank 25A when it is rotated by 180° from the reference orientation. Hereinafter, the rotation direction of the ink tank 25A shown in FIGS. 5A and 5B will also be referred to as "second rotation direction".

In response to the ink tank 25A being rotated by 90° in the second rotation direction, the fourth surface 44 side is moved downward, and the ink IN flows into the second atmospheric air chamber 121 via the second atmospheric air introducing portion 120 (FIG. 5A). Hereinafter, this orientation will also be referred to as "90° rotated orientation toward the right". In the 90° rotated orientation toward the right, the ink IN contained in the ink tank 25A is stored in a region on the fourth surface 44 side of the second atmospheric air chamber 121. Because the second atmospheric air intake inlet 123 is located at a position closer to the third surface 43 side, in this orientation, the second atmospheric air intake inlet 123 is located in an upper region of the second atmospheric air chamber 121. Accordingly, leakage of the ink IN to the outside via the second atmospheric air intake inlet 123 is suppressed.

In response to the ink tank 25A being further rotated in the second rotation direction and brought into the reversed orientation, the second atmospheric air introducing inlet 124 is moved upward, and the ink IN is stored in a region on the second wall portion 42 side of the ink containing portion 100 (FIG. 5B). Also, in the 90° rotated orientation toward the right, the ink IN that has flowed into the second atmospheric air introducing portion 120 is stored in a region on the second surface 42 side of the second atmospheric air chamber 121. For this reason, it is desirable that the second atmospheric air chamber 121 has at least a volume larger than that of the second atmospheric air communication path 122 so as to be capable of storing therein the ink IN that has flowed into the second atmospheric air communication path 122 during the time period during which the ink tank 25A is brought into the reversed orientation from the reference orientation. In the reversed orientation, as described with reference to FIG. 4B, a situation is suppressed in which the ink IN contained in the ink containing portion 100 flows into the first atmospheric air chamber 111 and the second atmospheric air chamber 121 via the first atmospheric air communication path 112 and the second atmospheric air communication path 122.

When the ink tank 25A is in the 90° rotated orientation toward the right, an air flow path to the ink containing portion 100 is ensured by the first atmospheric air introducing portion 110 (FIG. 5A). When the ink tank 25A is in the reversed orientation, an air flow path to the ink containing portion 100 is ensured by the second atmospheric air introducing portion 120 (FIG. 5B). Accordingly, when the ink tank 25A is rotated in the second rotation direction, leakage of the ink IN to the outside due to the expansion of the air contained in the ink containing portion 100 is suppressed in the same manner as when the ink tank 25A is rotated in the first rotation direction.

Conclusion

As described above, with the ink tank 25A of the present embodiment, even when the ink tank 25A is rotated from the reference orientation and brought into another orientation or the ink tank 25A is placed in an environment in which the air contained in the ink containing portion 100 expands, leakage of the ink IN to the outside is suppressed. In addition thereto, with the ink tank 25A of the present embodiment, the tank unit 20 including the ink tank 25A, and the printer 10 including the tank unit 20, various advantageous effects described in connection with the first embodiment can be achieved.

B. Second Embodiment

Figure 6:
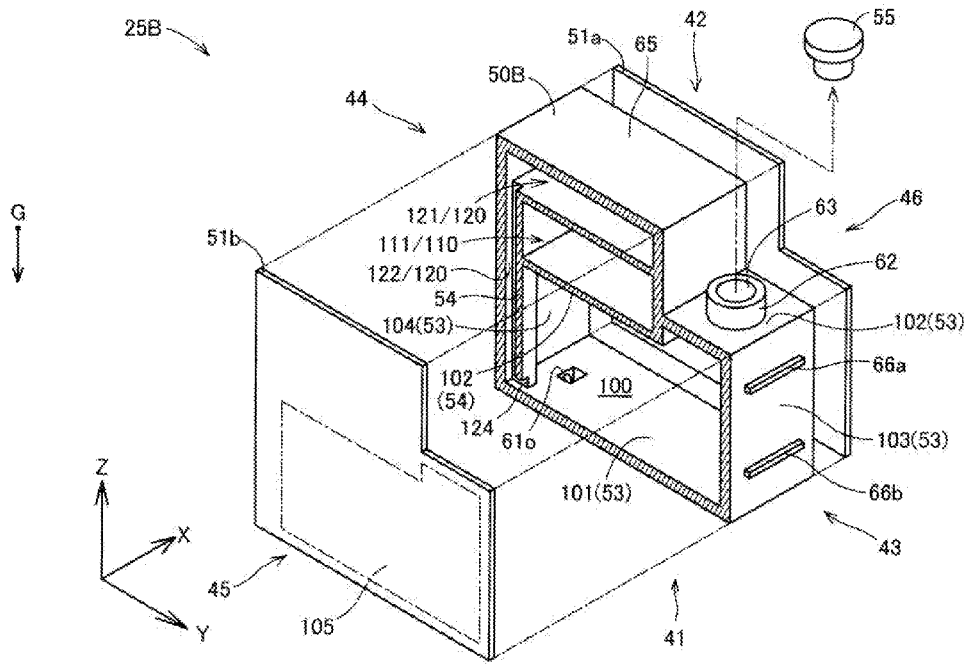
FIG. 6 is a schematic exploded perspective view of an ink tank according to a second embodiment.

FIG. 6 is a schematic exploded perspective view of an ink tank 25B according to a second embodiment of the invention. The ink tank 25B according to the second embodiment has the same configuration as the ink tank 25A according to the first embodiment except for the following points, and can be attached to the tank unit 20 of the printer 10 as described in the first embodiment. In the following description and the diagrams that will be referred to, the same constituent elements as those described in the first embodiment or corresponding constituent elements are given the same names and reference numerals as those used in the first embodiment.

In the ink tank 25B according to the second embodiment, the case member 50B constituting the main body of ink tank 25B has an opening on the fifth surface 45 side, as with the sixth surface 46. A sheet member 51 is bonded to the opening of the case member 50B provided on the fifth surface 45 side, as with the sixth surface 46. In the following description, the sheet member 51 bonded on the sixth surface 46 side will be referred to as "first sheet member 51*a*", and the sheet member 51 bonded on the fifth surface 45 side will be referred to as "second sheet member 51*b*".

In the case member 50B, the second atmospheric air communication path 122 of the second atmospheric air introducing portion 120 is provided at a position facing the second sheet member 51*b* provided on the fifth surface 45 side. Accordingly, in the ink tank 25B, the first atmospheric air introducing inlet 114 is located at a position closer to the sixth wall portion 106 side, and the second atmospheric air introducing inlet 124 is located at a position closer to the fifth wall portion 105 side. With this configuration, in the ink tank 25B, ink leakage is suppressed as described below.

Figure 7A:
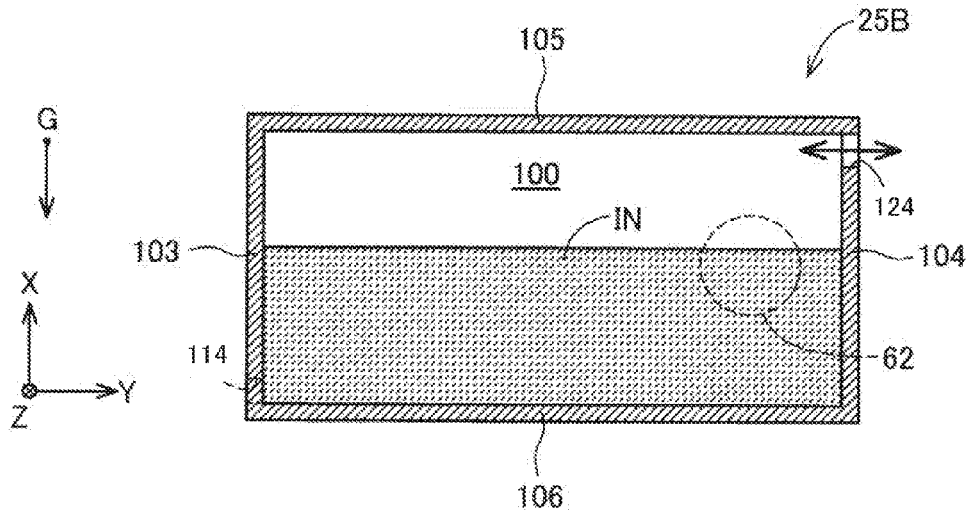
FIGS. 7A and 7B are schematic diagrams illustrating the effect of suppressing ink leakage in the ink tank according to the second embodiment.
Figure 7B:
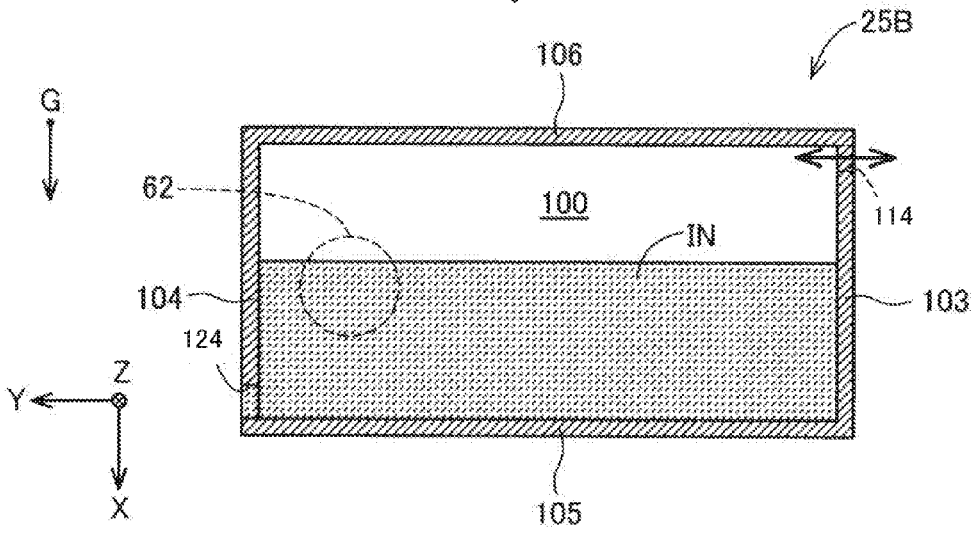

FIGS. 7A and 7B are schematic diagrams illustrating the effect of suppressing ink leakage in the ink tank 25B according to the second embodiment. FIGS. 7A and 7B each schematically illustrate a cross section of the ink containing portion 100 as viewed in a direction from the first wall portion 101 toward the second wall portion 102. In FIGS. 7A and 7B, the orientation in which the ink tank 25B is disposed is different. In FIGS. 7A and 7B, most of the other constituent elements of the ink tank 25B provided around the ink containing portion 100 are not illustrated for the sake of convenience.

When the ink tank 25B is disposed such that the sixth wall portion 106 side becomes the bottom and the fifth wall portion 105 side becomes the top, the second atmospheric air introducing inlet 124 is located in an upper region (FIG. 7A). Accordingly, the air flow path to the ink containing portion 100 is formed by the first atmospheric air introducing portion 110. Conversely, when the ink tank 25B is disposed such that the fifth wall portion 105 side becomes the bottom and the sixth wall portion 106 side becomes the top, the first atmospheric air introducing inlet 114 is located in an upper region (FIG. 7B). Accordingly, the air flow path to the ink containing portion 100 is formed by the second atmospheric air introducing portion 120. Accordingly, when the ink tank 25B is brought into an orientation in which the fifth wall portion 105 side or the sixth wall portion 106 side faces downward, leakage that occurs as a result of the ink IN contained in the ink containing portion 100 being forced to the outside due to the expansion of the air contained in the ink containing portion 100 is suppressed.

As described above, with the ink tank 25B according to the second embodiment, it is possible to obtain, in addition to the effect of suppressing ink leakage as described in the first embodiment, the effect of suppressing ink leakage when the ink tank is in an orientation in which the fifth wall portion 105 side or the sixth wall portion 106 side faces downward. In addition thereto, with the ink tank 25B according to the second embodiment, the tank unit 20 including the ink tank, and the printer 10 including the tank unit, various advantageous effects similar to those described in connection with the first embodiment can be achieved.

C. Third Embodiment

Figure 8:
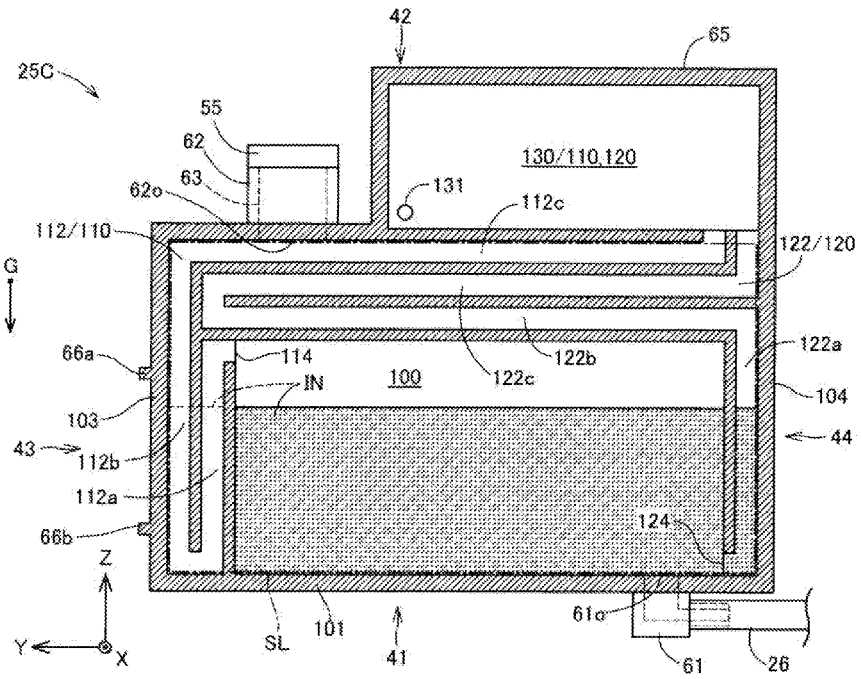
FIG. 8 is a schematic cross-sectional view showing a configuration of an ink tank according to a third embodiment.

FIG. 8 is a schematic cross-sectional view showing a configuration of an ink tank 25C according to a third embodiment of the invention. The ink tank 25C according to the third embodiment has substantially the same configuration as the ink tank 25A according to the first embodiment except for the following points, and can be attached to the tank unit 20 of the printer 10 as described in the first embodiment. In the following description and the diagrams that will be referred to, the same constituent elements as those described in the first embodiment or corresponding constituent elements are given the same names and reference numerals as those used in the first embodiment.

In the ink tank 25C according to the third embodiment, one common atmospheric air chamber 130 is provided in the atmospheric air chamber housing portion 65, instead of the first atmospheric air chamber 111 and the second atmospheric air chamber 121. The common atmospheric air chamber 130 is provided with an air intake inlet 131, which is a through hole that communicates with the outside and is provided to draw atmospheric air into the ink tank 25C. It is desirable that the air intake inlet 131 is provided at a position closer to the first surface 41 side so as to be capable of storing the ink IN in the atmospheric air chamber housing portion 65 when the ink tank is in the reversed orientation. The air intake inlet 131 corresponds to a subordinate concept of the common atmospheric air intake portion of the invention.

As will be described later, the common atmospheric air chamber 130 stores therein the ink IN that has flowed into the first atmospheric air communication path 112 or the second atmospheric air communication path 122 when the ink tank 25C is rotated from the reference orientation. For this reason, it is desirable that the common atmospheric air chamber 130 has at least a volume larger than that of the first atmospheric air communication path 112 and the second atmospheric air communication path 122.

In the third embodiment, the first atmospheric air introducing portion 110 and the second atmospheric air introducing portion 120 share the common atmospheric air chamber 130. The common atmospheric air chamber 130 is connected to both the first atmospheric air communication path 112 of the first atmospheric air introducing portion 110 and the second atmospheric air communication path 122 of the second atmospheric air introducing portion 120. In the first atmospheric air introducing portion 110, the third path portion 112*c* of the first atmospheric air communication path 112 extends to the proximity of the end portion of the fourth wall portion 104, and is connected to the lower end of the common atmospheric air chamber 130.

The second atmospheric air communication path 122 of the second atmospheric air introducing portion 120 includes a first path portion 122*a*, a second path portion 122*b* and a third path portion 122*c*. The first path portion 122*a* extends in the direction of the arrow Z from the second atmospheric air introducing inlet 124 to an upper region of the ink containing portion 100. The second path portion 122*b* is bent at the upper end of the first path portion 122*a* and extends to a point short of the second path portion 112*b* of the first atmospheric air communication path 112. The third path portion 122*c* is bent at an end portion of the second path portion 122*b* on the third surface 43 side, and extends in a direction opposite to the direction of the arrow Y. The third path portion 122*c* is connected to the lower end of the common atmospheric air chamber 130 at an end portion on the fourth surface 44 side.

Figure 9A:
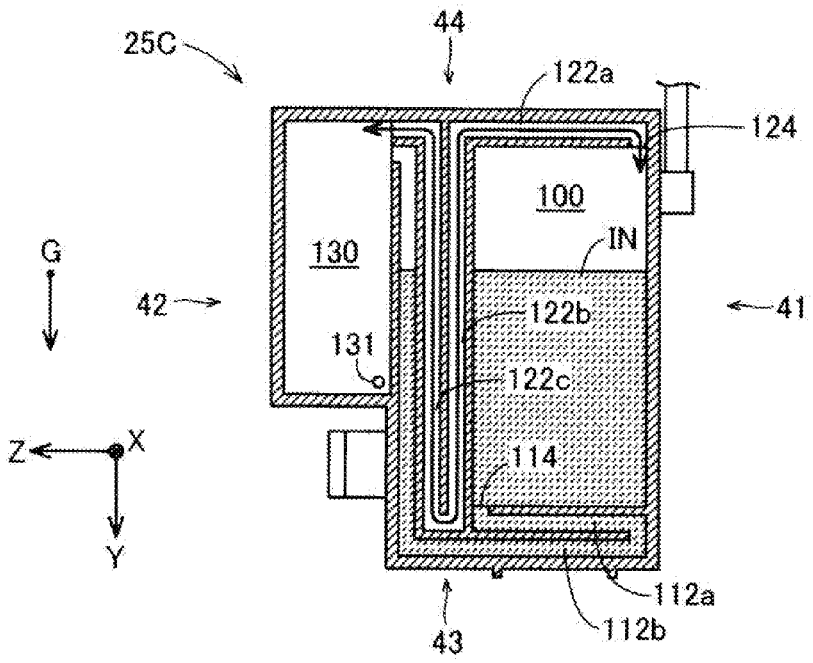
FIGS. 9A and 9B are schematic diagrams illustrating states when the ink tank according to the third embodiment is rotated in the first rotation direction.
Figure 9B:
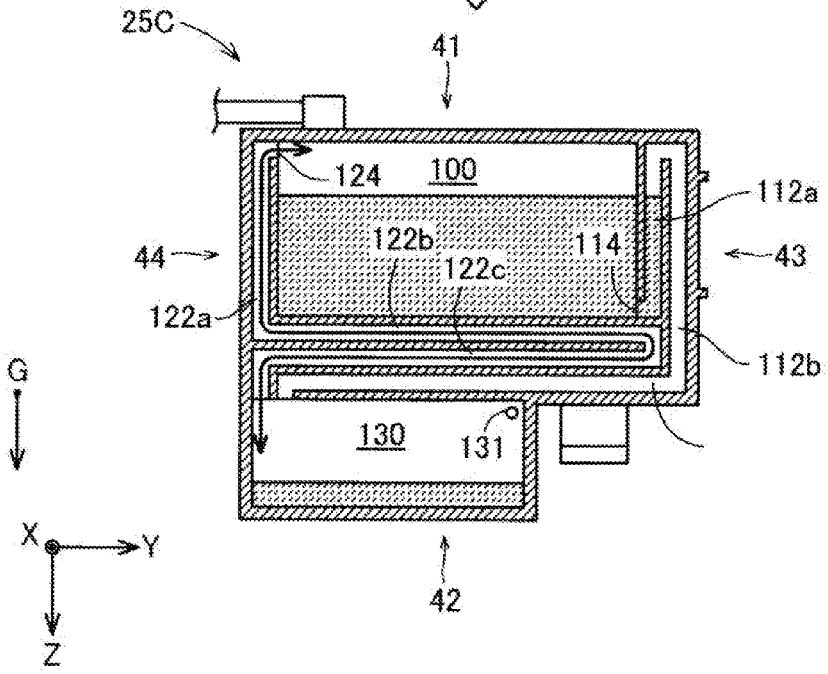

The effect of suppressing leakage of the ink IN in the ink tank 25C will be described by making reference to FIGS. 9A, 9B, 10A and 10B in sequence. FIGS. 9A and 9B schematically illustrate the states of the ink tank 25C when it is rotated in the first rotation direction, as in FIGS. 4A and 4B. When the ink tank 25C is brought into the 90° rotated orientation toward the left, the ink IN flows halfway through the third path portion 112*c* of the first atmospheric air communication path 112 via the first atmospheric air introducing inlet 114, but does not reach the common atmospheric air chamber 130 (FIG. 9A). In this state, the air flow path to the ink containing portion 100 is formed by the second atmospheric air introducing portion 120.

When the ink tank 25C is further rotated in the first rotation direction and brought into the reversed orientation, the ink IN flowed into the second path portion 112*b* and the third path portion 112*c* when the ink tank was in the 90° rotated orientation toward the left flows into the common atmospheric air chamber 130 and then stored (FIG. 9B). In this state as well, in the same manner as when the ink tank was in the 90° rotated orientation toward the left, the air flow path to the ink containing portion 100 is formed by the second atmospheric air introducing portion 120.

Figure 10A:
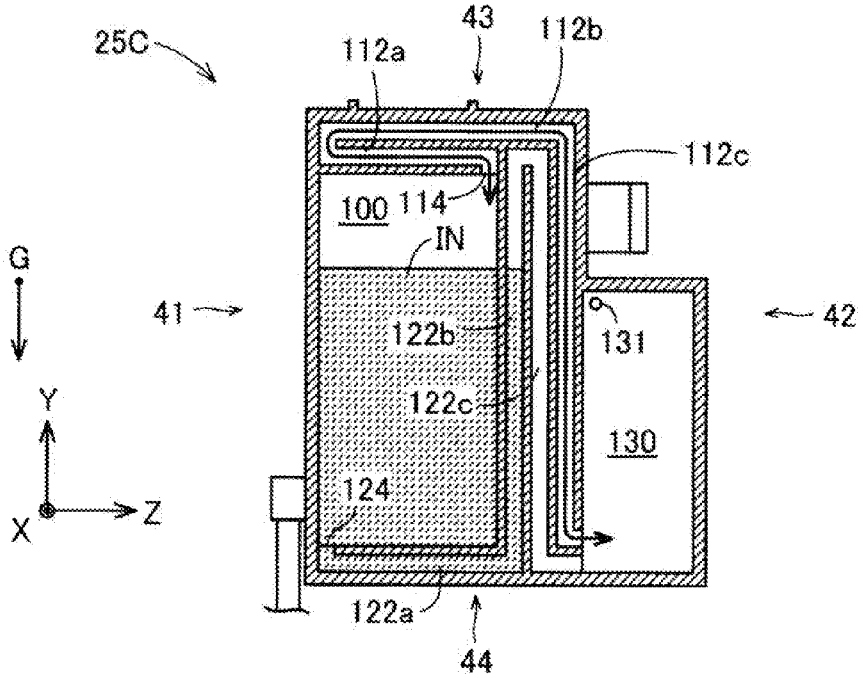
FIGS. 10A and 10B are schematic diagrams illustrating states when the ink tank according to the third embodiment is rotated in the second rotation direction.
Figure 10B:
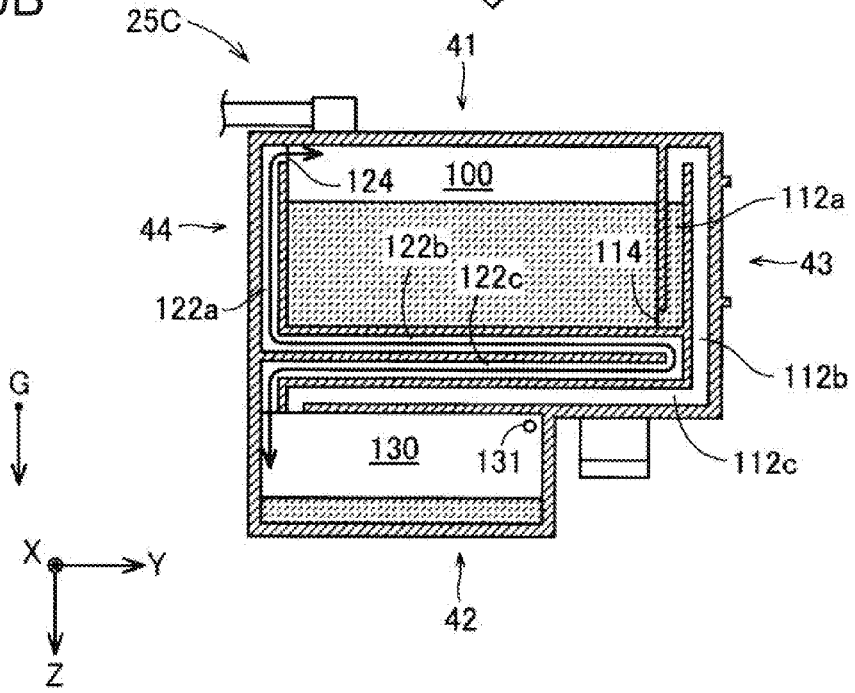

FIGS. 10A and 10B schematically illustrate the states of the ink tank 25C when it is rotated in the second rotation direction, as in FIGS. 5A and 5B. When the ink tank 25C is brought into the 90° rotated orientation toward the right, the ink IN flows halfway through the second path portion 122*b* of the second atmospheric air communication path 122 via the second atmospheric air introducing inlet 124, but does not reach the common atmospheric air chamber 130 (FIG. 10A). In this state, the air flow path to the ink containing portion 100 is formed by the first atmospheric air introducing portion 110.

When the ink tank 25C is further rotated in the second rotation direction and brought into the reversed orientation, the ink IN flowed into the first path portion 122*a* and the second path portion 122*b* when the ink tank was in the 90° rotated orientation toward the right flows into the common atmospheric air chamber 130 and then stored (FIG. 10B). In this state, the air flow path to the ink containing portion 100 is formed by the second atmospheric air introducing portion 120.

As described above, with the ink tank 25C according to the third embodiment, the air flow path to the ink containing portion 100 is formed in any of the following orientations: the 90° rotated orientation toward the left; the 90° rotated orientation toward the right; and the reversed orientation. Accordingly, as described in the first embodiment, leakage that occurs as a result of the ink IN being forced to the outside due to the expansion of the air contained in the ink containing portion 100 is suppressed.

Also, in the ink tank 25C according to the third embodiment, the first atmospheric air introducing portion 110 and the second atmospheric air introducing portion 120 include a path portion that extends to a positon higher than the surface of the ink IN contained in the ink containing portion 100 when the ink tank is in the 90° rotated orientation toward the left or in the 90° rotated orientation toward the right. Accordingly, when the ink tank is in the 90° rotated orientation toward the left or in the 90° rotated orientation toward the right, a situation is suppressed in which the ink IN flows into the common atmospheric air chamber 130.

In the ink tank 25C according to the third embodiment, the common atmospheric air chamber 130 commonly connected to the first atmospheric air introducing portion 110 and the second atmospheric air introducing portion 120 is provided, and thus it is possible to achieve simplification and miniaturization of the configuration of the ink tank 25C. In addition thereto, with the ink tank 25B according to the second embodiment, the tank unit 20 including the ink tank, and the printer 10 including the tank unit, various advantageous effects similar to those described in connection with the first embodiment can be achieved.

D. Fourth Embodiment

Figure 11:
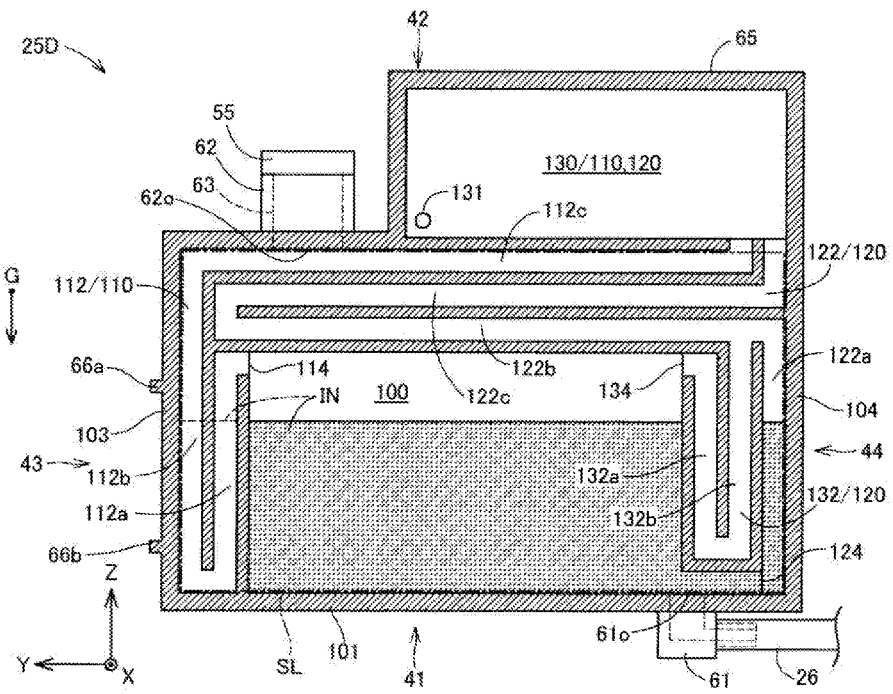
FIG. 11 is a schematic cross-sectional view showing a configuration of an ink tank according to a fourth embodiment.

FIG. 11 is a schematic cross-sectional view showing a configuration of an ink tank 25D according to a fourth embodiment of the invention. The ink tank 25D according to the fourth embodiment has substantially the same configuration as the ink tank 25C according to the third embodiment except for the following points, and can be attached to the tank unit 20 of the printer 10 as described in the first embodiment. In the following description and the diagrams that will be referred to, the same constituent elements as those described in the third embodiment or corresponding constituent elements are given the same names and reference numerals as those used in the third embodiment.

In the ink tank 25D according to the fourth embodiment, the second atmospheric air introducing portion 120 includes, in addition to the second atmospheric air communication path 122, a third atmospheric air communication path 132. The third atmospheric air communication path 132 is a tubular path that communicates between the ink containing portion 100 and the common atmospheric air chamber 130. The third atmospheric air communication path 132 is constituted by a groove provided on a surface, which is opposite to the sheet member 51, of the inner wall portion 54 protruding toward the inside of the ink containing portion 100 along the surface of the sheet member 51, as with the second atmospheric air communication path 122.

The third atmospheric air communication path 132 includes a first path portion 132*a* and a second path portion 132*b*. The first path portion 132*a* and the second path portion 132*b* extend in parallel to each other along the direction of the arrow Z at a position adjacent to the first path portion 122*a* of the second atmospheric air communication path 122 on the fourth surface 44 side. The first path portion 132*a* is provided on a side of the second path portion 132*b* in the direction of the arrow Y, and is connected to the ink containing portion 100 in an upper region of the ink containing portion 100.

A third atmospheric air introducing inlet 134 is formed in an area where the first path portion 132*a* and the ink containing portion 100 intersect with each other. The third atmospheric air introducing inlet 134 is provided in an upper region of the ink containing portion 100, or in other words, a region between the second wall portion 102 and a midpoint between the second wall portion 102 and the first wall portion 101. The first path portion 132*a* extends from the third atmospheric air introducing inlet 134 to a lower region of the ink containing portion 100. The second path portion 132*b* is bent at the lower end of the first path portion 132*a*, extends in the direction of the arrow Z, and is connected to the second path portion 122*b* of the second atmospheric air communication path 122.

The third atmospheric air communication path 132 is connected to the common atmospheric air chamber 130 via the second path portion 122*b* and the third path portion 122*c* of the second atmospheric air communication path 122. When the ink tank 25D is in the reference orientation, the third atmospheric air communication path 132 functions, together with the first atmospheric air communication path 112 of the first atmospheric air introducing portion 110, as a path for introducing atmospheric air into the ink containing portion 100. Also, as will be described below, the third atmospheric air communication path 132 functions as a path that ensures an air flow to the ink containing portion 100 when the ink tank 25D is disposed in an inclined manner from the reference orientation.

Figure 12:
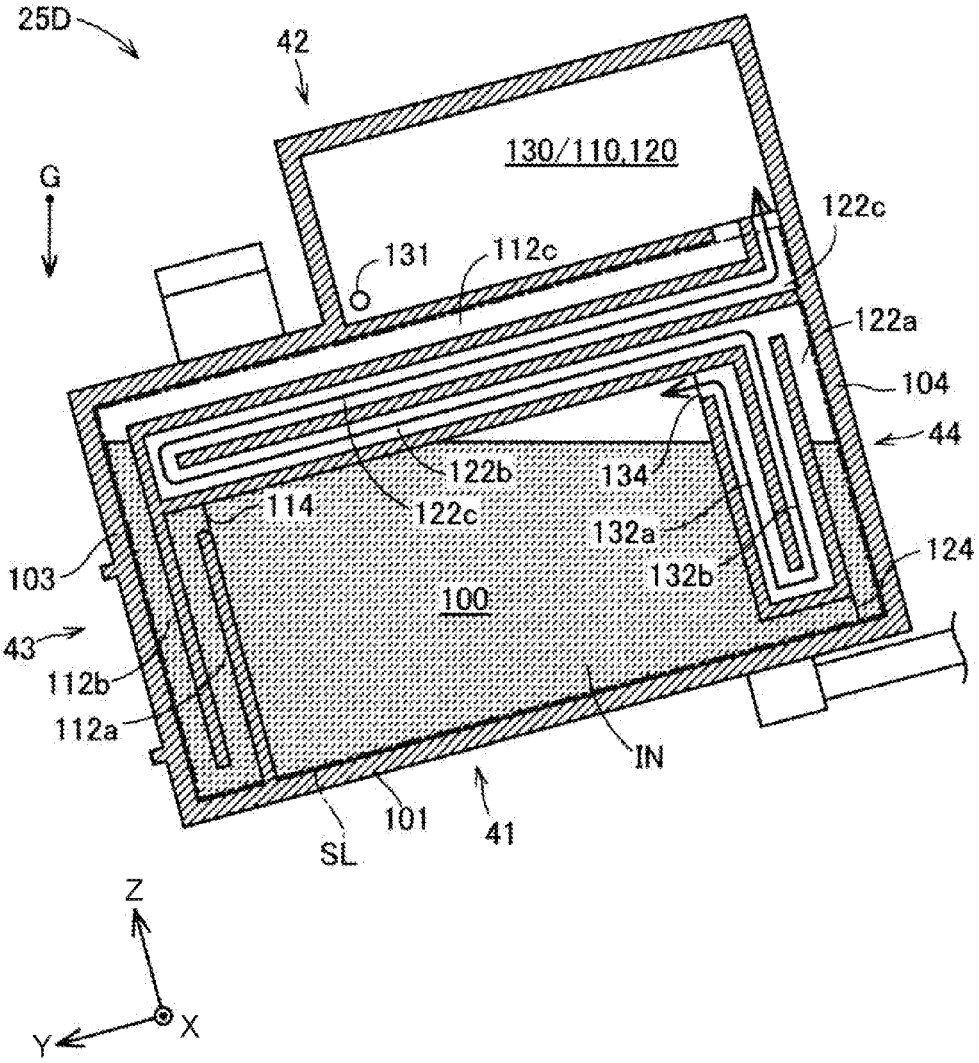
FIG. 12 is a schematic diagram illustrating a function of a third atmospheric air communication path according to the fourth embodiment.

FIG. 12 is a schematic diagram illustrating the function of the third atmospheric air communication path 132. FIG. 12 shows an example in which the ink tank 25D is rotated in the first rotation direction from the reference orientation and inclined. When the ink tank 25D is rotated in the first rotation direction from the reference orientation and inclined, the second atmospheric air introducing inlet 124 together with the first atmospheric air introducing inlet 114 may be closed by the ink IN depending on the amount of ink IN contained in the ink containing portion 100.

With the ink tank 25D, even when it is inclined as described above, the third atmospheric air introducing inlet 134 is located at an upper position than the first atmospheric air introducing inlet 114, and thus with the third atmospheric air communication path 132, a situation is suppressed in which an air flow path to the ink containing portion 100 is blocked. Accordingly, leakage of the ink IN to the outside due to the expansion of the air contained in the ink containing portion 100 when the ink tank 25D is disposed in an inclined manner is suppressed.

In order to provide the function of the third atmospheric air communication path 132 when the ink tank 25D is disposed in an inclined manner as described above, it is desirable that the third atmospheric air introducing inlet 134 is provided at least at the following position. It is desirable that the third atmospheric air introducing inlet 134 is provided in a region where the air is present when the ink tank 25D is brought into an inclined state in which the first atmospheric air introducing inlet 114 and the second atmospheric air introducing inlet 124 are closed by the ink IN, with the ink containing portion 100 containing atmospheric air and the ink IN in an amount equal to ⅔ of the ink capacity of the ink containing portion 100. The third atmospheric air introducing inlet 134 may be provided at the same height as the first atmospheric air introducing inlet 114 when the ink tank 25D is in the reference orientation, or may be provided at a different height.

As described above, with the ink tank 25D according to the fourth embodiment, as a result of having the third atmospheric air communication path 132, a situation is suppressed in which when the ink tank 25D is not in the reference orientation, the admission of atmospheric air into the ink containing portion 100 is blocked. In addition thereto, with the ink tank 25D according to the fourth embodiment, the tank unit 20 including the ink tank, and the printer 10 including the tank unit, various advantageous effects similar to those described in connection with the embodiments described above can be achieved.

E. Fifth Embodiment

Figure 13:
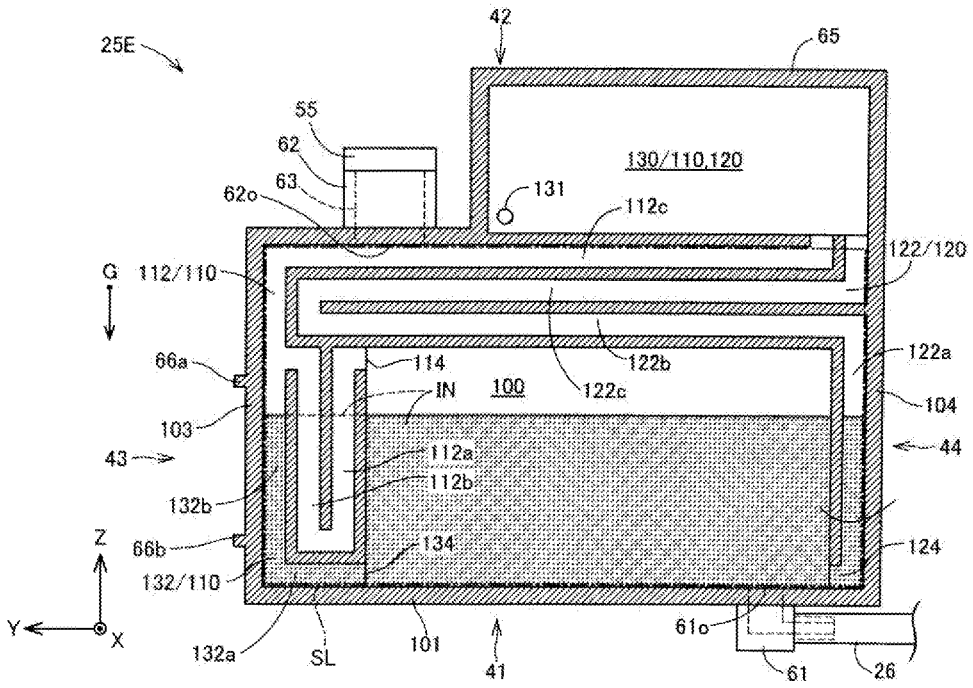
FIG. 13 is a schematic cross-sectional view showing a configuration of an ink tank according to a fifth embodiment.

FIG. 13 is a schematic cross-sectional view showing a configuration of an ink tank 25E according to a fifth embodiment of the invention. The ink tank 25E according to the fifth embodiment has substantially the same configuration as the ink tank 25D according to the fourth embodiment except for the following points, and can be attached to the tank unit 20 of the printer 10 as described in the first embodiment. In the following description and the diagrams that will be referred to, the same constituent elements as those described in the fourth embodiment or corresponding constituent elements are given the same names and reference numerals as those used in the fourth embodiment.

In the ink tank 25E according to the fifth embodiment, the third atmospheric air communication path 132 is provided in the first atmospheric air introducing portion 110 rather than in the second atmospheric air introducing portion 120. The third atmospheric air communication path 132 is constituted by a groove provided on a surface, which is opposite to the sheet member 51, of the inner wall portion 54 protruding toward the inside of the ink containing portion 100 along the surface of the sheet member 51, as with the first atmospheric air communication path 112. The second path portion 132*b* of the third atmospheric air communication path 132 extends in the direction of the arrow Z at a position closer to the third surface 43 side with respect to the first path portion 112*a* and the second path portion 112*b* of the first atmospheric air communication path 112, and is connected to the third path portion 112*c* of the first atmospheric air communication path 112. The first path portion 132*a* of the third atmospheric air communication path 132 extends in a direction opposite to the direction of the arrow Y from the lower end of the second path portion 132*b*, and is connected to the ink containing portion 100.

In the fifth embodiment, the third atmospheric air introducing inlet 134 is provided in a region between the third wall portion 103 and a midpoint between the third wall portion 103 and the fourth wall portion 104. Also, the third atmospheric air introducing inlet 134 is provided in a lower region of the ink containing portion 100, or in other words, in a region between the first wall portion 101 and a midpoint between the first wall portion 101 and the second wall portion 102. In the ink tank 25E according to the fifth embodiment, the first atmospheric air introducing inlet 114 is provided in an upper region on the third wall portion 103 side, and the third atmospheric air introducing inlet 134 is provided in a lower region on the third wall portion 103 side.

With the ink tank 25E according to the fifth embodiment, even when it is brought into an orientation in which the first atmospheric air introducing inlet 114 and the second atmospheric air introducing inlet 124 are located at a lower position than the third atmospheric air introducing inlet 134, with the third atmospheric air communication path 132, a situation is suppressed in which the admission of atmospheric air into the ink containing portion 100 is blocked. Accordingly, in such an orientation, leakage that occurs as a result of the ink IN being forced to the outside due to the expansion of the air contained in the ink containing portion 100 is suppressed. In addition thereto, with the ink tank 25E according to the fifth embodiment, the tank unit 20 including the ink tank, and the printer 10 including the tank unit, various advantageous effects similar to those described in connection with the embodiments described above can be achieved.

F. Sixth Embodiment

Figure 14:
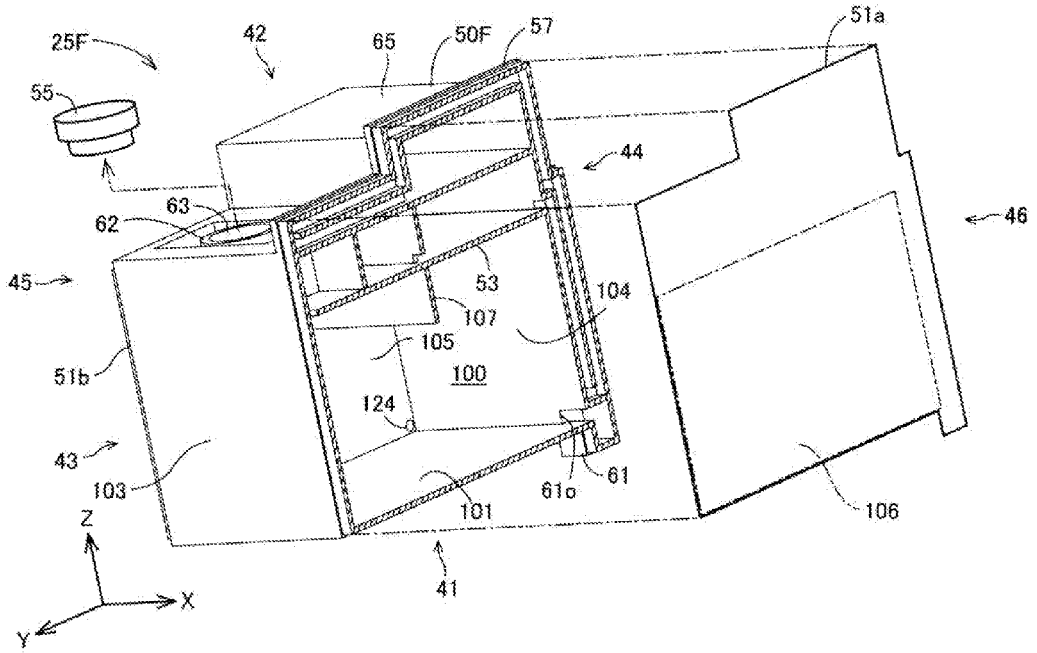
FIG. 14 is a schematic exploded perspective view of an ink tank according to a sixth embodiment.
Figure 15:
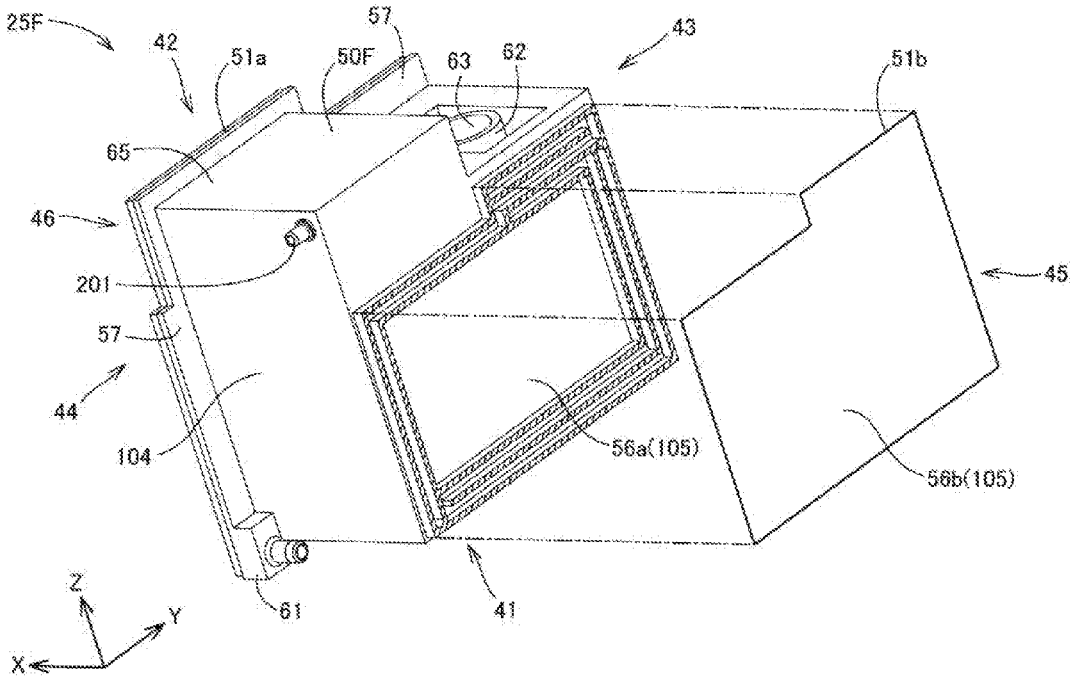
FIG. 15 is another schematic exploded perspective view of the ink tank according to the sixth embodiment.
Figure 16:
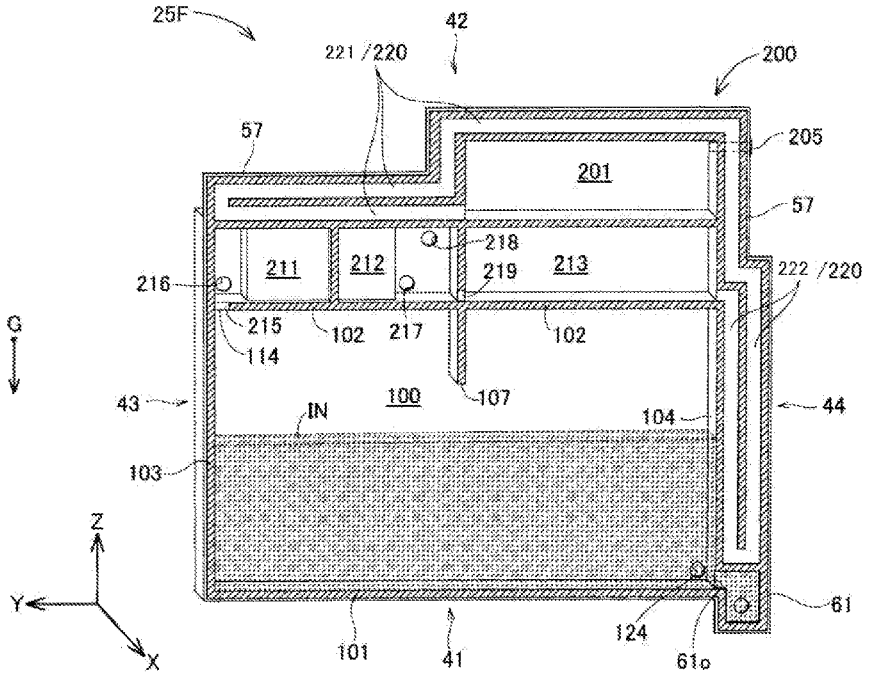
FIG. 16 is a schematic perspective view showing an internal structure of the ink tank according to the sixth embodiment.
Figure 17:
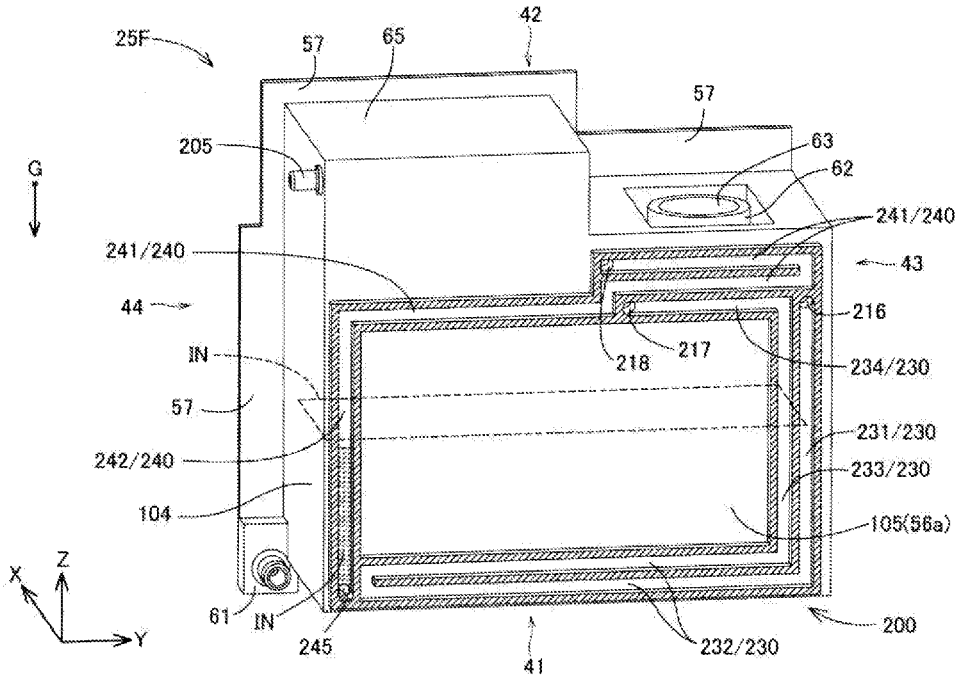
FIG. 17 is a schematic perspective view showing a configuration on a fifth surface side of the ink tank according to the sixth embodiment.

A configuration of an ink tank 25F according to a sixth embodiment of the invention will be described with reference to FIGS. 14 to 17. FIG. 14 is a schematic exploded perspective view of the ink tank 25F as viewed from the sixth surface 46 side. FIG. 15 is a schematic exploded perspective view of the ink tank 25F as viewed from the fifth surface 45 side. FIG. 16 is a schematic perspective view showing an internal configuration of the ink tank 25F. FIG. 17 is a schematic perspective view showing a configuration on the fifth surface 45 side of the ink tank 25F. FIGS. 16 and 17 show an example of a state when the ink IN is contained in the ink tank 25F positioned in the reference orientation. Also, in FIGS. 16 and 17, the sheet members 51*a* and 51*b* are not illustrated for the sake of convenience. In FIG. 17, the position of the surface of the ink IN contained in the ink containing portion 100 is indicated by a broken line.

The basic configuration of the ink tank 25F according to the sixth embodiment is the same as that of the ink tanks described in the embodiments above. The ink tank 25F can be attached to a tank unit of a printer having the same configuration as that described in the first embodiment. In the following description and the diagrams that will be referred to, unless otherwise stated, the same constituent elements as those described in the embodiments given above or corresponding constituent elements and members are given the same names and reference numerals as those used in the embodiments given above.

The main body of the ink tank 25F is constituted by a case member 50F and two sheet members 51*a* and 51*b* (FIGS. 14 and 15). The case member 50F is configured as a hollow box that is open on the sixth surface 46 side (FIG. 14). The first sheet member 51*a* is bonded by welding so as to seal the entire opening on the sixth surface 46 side of the case member 50F.

A flow path groove constituting an atmospheric air introducing portion 200 (described later) is formed on a wall surface, which is on the fifth surface 45 side, of the case member 50F (FIG. 15). The second sheet member 51*b* is bonded to the fifth surface 45 by welding so as to cover the entire flow path groove. In the ink tank 25F according to the sixth embodiment, the wall portion constituting the fifth surface 45 has a double-ply structure in which an inner wall portion 56*a* constituted by the outer wall portion 53 of the case member 50 and an outer wall portion 56*b* constituted by the second sheet member 51*b* are overlaid on each other. In the diagrams that are referred to in connection with the sixth embodiment, the areas where the sheet members 51*a* and 51*b* are welded to the case member 50F are hatched with oblique lines.

In the ink tank 25F, the ink containing portion 100 is configured as a hollow part having a substantially rectangular parallelepiped space in the ink tank 25F and provided in a lower region of the case member 50F (FIG. 16). The ink containing portion 100 is formed so as to extend substantially over the width direction and the front-rear direction. In the ink tank 25F, at least the third wall portion 103 of the ink containing portion 100 is configured to be transparent or translucent so as to function as the visible portion for allowing the amount of ink contained in the ink containing portion 100 to be visible.

In the second wall portion 102 of the ink containing portion 100, an ink injection inlet 62*o* is formed in an area where the second wall portion 102 intersects with the through hole 63 of the ink injection portion 62. In the lower end of the ink containing portion 100, an ink supply portion 61 is provided so as to protrude in a direction opposite to the direction of the arrow Y and protrude in a direction opposite to the direction of the arrow Z.

In addition thereto, a partition wall 107 is provided at substantially the center in the direction of the arrow Y of the ink containing portion 100. The partition wall 107 intersects with the fifth wall portion 105 and the second wall portion 102, and extends from the second wall portion 102 toward the first wall portion 101 to a height position between the second wall portion 102 and a midpoint between the second wall portion 102 and the first wall portion 101. The function of the partition wall 107 will be described later.

In the ink tank 25F, the atmospheric air introducing portion 200 for introducing atmospheric air into the ink containing portion 100 is configured as follows. The atmospheric air introducing portion 200 includes an atmospheric air chamber 201, an air intake portion 205, three buffer chambers 211 to 213, and three flow path grooves 220, 230 and 240.

The atmospheric air chamber 201 is configured as a hollow part in the atmospheric air chamber housing portion 65 protruding in a stepwise configuration in the second surface 42 (FIG. 16). The atmospheric air chamber 201 communicates with the outside via the air intake portion 205. The air intake portion 205 is configured as a substantially cylindrical part protruding in a direction opposite to the direction of the arrow Y from a wall portion, which is on the fourth surface 44 side, of the atmospheric air chamber housing portion 65 (FIG. 17). The air intake portion 205 communicates with a position closer to the upper end of the atmospheric air chamber 201. Also, the air intake portion 205 is provided at a position closer to the fifth surface 45 side. As will be described later, the atmospheric air chamber 201 is connected to a first flow path groove 220. It is desirable that the atmospheric air chamber 201 has a volume larger than the total volume of the three flow path grooves 220, 230 and 240 so as to be capable of storing the ink IN that has flowed into the three flow path grooves 220, 230 and 240.

The three buffer chambers 211 to 213 (FIG. 16) are hollow parts having a function of working as a flow path for atmospheric air and a function of storing the ink IN that has flowed into the atmospheric air introducing portion 200 so as to suppress entry of the ink IN into the atmospheric air chamber 201. The buffer chambers 211 to 213 are linearly aligned in the direction of the arrow Y above the ink containing portion 100. The buffer chambers 211 to 213 have substantially the same height. The first buffer chamber 211 and the second buffer chamber 212 have a volume smaller than that of the third buffer chamber 213.

The first buffer chamber 211 and the second buffer chamber 212 are provided adjacent to each other at a position closer to the third surface 43 side with respect to the atmospheric air chamber 201 of the atmospheric air chamber housing portion 65. The first buffer chamber 211 is located on the third surface 43 side, and the second buffer chamber 212 is located on the fourth surface 44 side. On a side that is opposite to the first buffer chamber 211 and the second buffer chamber 212 in a direction opposite to the direction of the arrow X, an ink injection portion 62 is provided (FIG. 17). The third buffer chamber 213 is provided at a position that is below the atmospheric air chamber 201 and is adjacent to the second buffer chamber 212 (FIG. 16). The width of the third buffer chamber 213 in the direction of the arrow Y is substantially the same as that of the atmospheric air chamber 201.

A communication path 215 that communicates with the ink containing portion 100 is further provided in the lower end of the first buffer chamber 211 (FIG. 16). The communication path 215 is constituted by a recess formed at an end face of the inner wall portion 54 that provides a partition between first buffer chamber 211 and the ink containing portion 100. A first atmospheric air introducing inlet 114 is formed in an area where the communication path 215 and the ink containing portion 100 intersect with each other. In a state in which the ink containing portion 100 contains the ink IN in an amount equal to ½ of its ink capacity, the first atmospheric air introducing inlet 114 is located in a region where the air is present. Also, the first atmospheric air introducing inlet 114 is located at a position that is closer to the second wall portion 102 than the first wall portion 101 and is closer to the third wall portion 103 than the fourth wall portion 104.

A first communication hole 216 penetrating the inner wall portion 56*a* is provided in the lower end of the first buffer chamber 211. The first communication hole 216 communicates with the second flow path groove 230 (FIG. 17) provided on a wall surface, which is on a side in a direction opposite to the direction of the arrow X, of the inner wall portion 56*a*.

The second buffer chamber 212 is provided with a second communication hole 217 and a third communication hole 218 that penetrate the inner wall portion 56*a* (FIG. 16). The second communication hole 217 is located on the lower end side of the second buffer chamber 212, and the third communication hole 218 is located on the upper end side of the second buffer chamber 212. The second communication hole 217 communicates with the second flow path groove 230, and the third communication hole 218 communicates with the third flow path groove 240 (FIG. 17). At the lower end of the second buffer chamber 212, a communication path 219 that communicates with the third buffer chamber 213 is provided (FIG. 16). The communication path 219 is constituted by a recess formed in the inner wall portion 54 that provides a partition between the second buffer chamber 212 and the third buffer chamber 213.

The first flow path groove 220 is provided on a surface, which is on the side of the direction of the arrow X, of a bulge wall portion 57 extending from the perimeter of the opening of the case member 50F provided on the sixth surface 46 side in the direction of the arrow Z and bulging in a direction opposite to the direction of the arrow Y (FIG. 16). The first flow path groove 220 communicates between the atmospheric air chamber 201 and the third buffer chamber 213. The first flow path groove 220 includes a horizontally bent path portion 221 and a vertically bent path portion 222.

The horizontally bent path portion 221 extends from a lower end, which is on the third surface 43 side, of the atmospheric air chamber 201 toward the front at a position above the first buffer chamber 211 and the second buffer chamber 212, is bent upward at a front end portion of the ink tank 25F, and extends toward the rear. Then, it extends to a rear end portion of the ink tank 25F by diverting around the upper portion of the atmospheric air chamber 201.

The vertically bent path portion 222 extends downward from the rear end portion of the horizontally bent path portion 221 located at the upper end of the ink tank 25F, is bent toward the front at a point short of the ink supply portion 61, and extends upward. Then, it is connected to the lower end of the third buffer chamber 213.

The second flow path groove 230 and the third flow path groove 240 are provided on a side of the inner wall portion 56*a* in a direction opposite to the direction of the arrow X (FIG. 17). The second flow path groove 230 corresponds to a subordinate concept of the first back path portion of the invention, and the third flow path groove 240 corresponds to a subordinate concept of the second back path portion of the invention.

The second flow path groove 230 communicates between the first buffer chamber 211 and the second buffer chamber 212. The second flow path groove 230 includes a first vertical path portion 231, a horizontally bent path portion 232, a second vertical path portion 233 and a horizontal path portion 234.

The first vertical path portion 231 extends from the first communication hole 216, which is located in the front end portion of the ink tank 25F and communicates with the first buffer chamber 211, to the lower end of the ink tank 25F. As described above, the first vertical path portion 231 includes a part extending from the first communication hole 216 to a region between the first wall portion 101 and a midpoint between the first wall portion 101 and the second wall portion 102. The horizontally bent path portion 232 extends from the lower end of the first vertical path portion 231 to a point short of a vertical path portion 242 located at the rear end portion of the ink tank 25F, is bent upward and extends back to a point short of the first vertical path portion 231 located at the front end portion of the ink tank 25F.

The second vertical path portion 233 extends from the front end portion on the upper area side of the horizontally bent path portion 232 to a height position of the upper end of the ink containing portion 100. The horizontal path portion 234 extends from the upper end of the second vertical path portion 233 toward the rear side, and is connected to the second communication hole 217 that communicates with the second buffer chamber 212.

The third flow path groove 240 communicates between the second buffer chamber 212 and the ink containing portion 100. The third flow path groove 240 includes a horizontally bent path portion 241 and the vertical path portion 242. The horizontally bent path portion 241 extends from the third communication hole 218, which communicates with the second buffer chamber 212, to the front end of the ink tank 25F, is bent downward and extends back toward the rear end portion of the ink tank 25F.

The vertical path portion 242 extends from the rear end portion of the horizontally bent path portion 241 to the lower end of the ink tank 25F. At the lower end portion of the vertical path portion 242, a fourth communication hole 245 is provided that penetrates the inner wall portion 56*a*, which is the fifth wall portion 105. The vertical path portion 242 includes a part extending from the fourth communication hole 245 to a region between the second wall portion 102 and a midpoint between the second wall portion 102 and the first wall portion 101. The fourth communication hole 245 communicates with the lower end portion of the ink containing portion 100. The fourth communication hole 245 is located at a position adjacent to the upper end portion of the ink supply portion 61 when the ink tank 25F is viewed in a direction opposite to the direction of the arrow X (FIG. 16).

The second atmospheric air introducing inlet 124 is formed at an area where the fourth communication hole 245 and the ink containing portion 100 intersect with each other (FIG. 16). A second atmospheric air introducing inlet 124 is located at a position that is closer to the first wall portion 101 than the second wall portion 102 and is closer to the fourth wall portion 104 than the third wall portion 103. In a state in which the ink containing portion 100 contains the ink IN in an amount equal to ½ of its ink capacity, the second atmospheric air introducing inlet 124 is located in a region where the ink IN is present. Also, in a state in which the ink containing portion 100 contains the ink IN in an amount equal to ½ of its ink capacity, when the ink tank 25F is brought into the reversed orientation, the second atmospheric air introducing inlet 124 is located in a region where the air is present.

In the ink tank 25F, a part of the atmospheric air path constituting the atmospheric air introducing portion 200, such as the buffer chambers 211 to 213 and the horizontally bent path portion 221, is disposed above the second wall portion 102 in which the ink injection inlet 62*o* is formed (FIG. 16). Accordingly, even when an excessive amount of ink IN is injected into the ink containing portion 100 from the ink injection portion 62, a situation is suppressed in which the ink IN that has flowed out of the ink containing portion 100 via the first atmospheric air introducing inlet 114 leaks to the outside via the atmospheric air introducing portion 200.

Air Flow Path when Ink Tank is in Reference Orientation

An air flow path to the ink containing portion 100 when the ink tank 25F is in the reference orientation will be described with reference to FIGS. 16 and 17. When the ink tank 25F is in the reference orientation, the air that has flowed into the atmospheric air chamber 201 via the air intake portion 205 flows into the third buffer chamber 213 via the horizontally bent path portion 221 and the vertically bent path portion 222 of the first flow path groove 220 (FIG. 16). The air in the third buffer chamber 213 flows into the second buffer chamber 212 via the communication path 219 and then flows into the second flow path groove 230 via the second communication hole 217 (FIG. 17).

The air that has flowed into the second flow path groove 230 passes through the horizontal path portion 234, the second vertical path portion 233 and the horizontally bent path portion 232 of the second flow path groove 230 in this order, and flows into the first buffer chamber 211 via the first communication hole 216 (FIG. 16). The air that has flowed into the first buffer chamber 211 flows into the ink containing portion 100 via the first atmospheric air introducing inlet 114 of the communication path 215. In the sixth embodiment, a flow path constituting the air flow path corresponds to a subordinate concept of the first atmospheric air communication portion.

Effect of Suppressing Ink Leakage

With the ink tank 25F, even when the ink containing portion 100 containing a predetermined amount of ink IN is rotated from the reference orientation, a part of the flow path constituting the atmospheric air introducing portion 200 is located at a position that is higher than the surface of the ink IN contained in the ink containing portion 100. As used herein, the term "a predetermined amount" may be, for example, an amount equal to ½ of the ink capacity of the ink containing portion 100. Also, as described in the embodiments above, the ink tank 25F includes the first atmospheric air introducing inlet 114 and the second atmospheric air introducing inlet 124 that are located at different height positions. As a result of having such a configuration, in the ink tank 25F, leakage of the ink IN to the outside is suppressed even when the ink tank is brought into various rotated orientations as will be described below.

Figure 18:
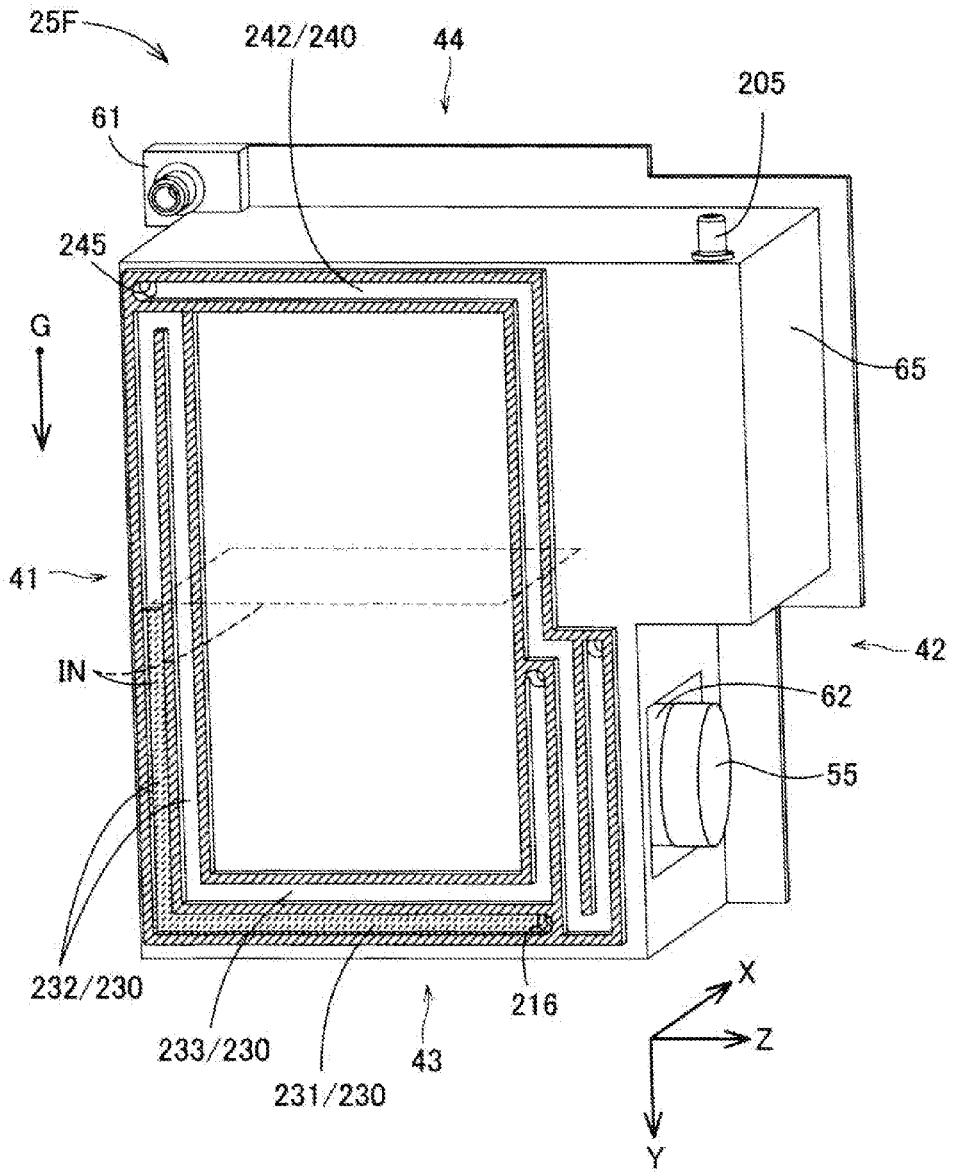
FIG. 18 is a schematic perspective view showing a state when the ink tank according to the sixth embodiment is brought into an orientation rotated by 90° toward the left.

Effect of Suppressing Ink Leakage when Ink Tank is Rotated by 90° from Reference Orientation FIG. 18 is a schematic perspective view showing a state when the ink tank 25F containing the ink IN is brought into the 90° rotated orientation toward the left. In FIG. 18, the position of the surface of the ink IN contained in the ink containing portion 100 is indicated by a broken line. Also, in FIG. 18, the second sheet member 51*b* is not illustrated for the sake of convenience.

When the ink tank 25F is brought into the 90° rotated orientation toward the left, the ink IN contained in the ink containing portion 100 flows into the horizontally bent path portion 232 of the second flow path groove 230 via the first buffer chamber 211. However, in this orientation, the horizontally bent path portion 232 extends to a region on the fourth wall portion 104 side that is located at an upper position. Accordingly, under the action of gravity, a situation is suppressed in which the ink IN passes through the horizontally bent path portion 232, reaches the second buffer chamber 212, and thus leakage of the ink IN to the outside is suppressed.

Figure 19:
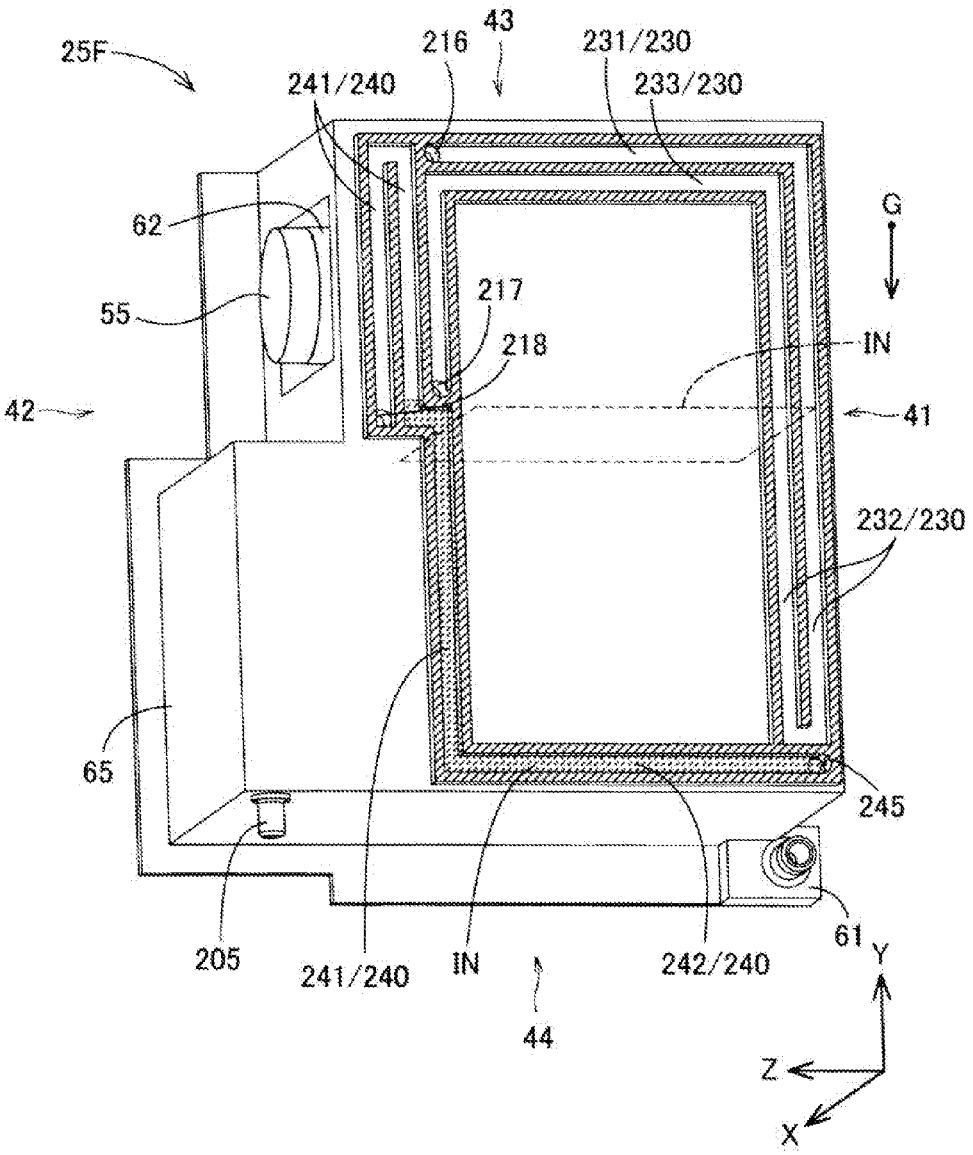
FIG. 19 is a schematic perspective view showing a state when the ink tank according to the sixth embodiment is brought into an orientation rotated by 90° toward the right.

FIG. 19 is a schematic perspective view showing a state when the ink tank 25F containing the ink IN is brought into the 90° rotated orientation toward the right. In FIG. 19, the second sheet member 51*b* is not illustrated for the sake of convenience. When the ink tank 25F is brought into the 90° rotated orientation toward the right, quite a large amount of ink IN contained in the ink containing portion 100 flows into the third flow path groove 240 via the fourth communication hole 245. However, in this orientation, the horizontally bent path portion 241 of the third flow path groove 240 extends to a region on the third wall portion 103 side located in an upper position. Accordingly, under the action of gravity, a situation is suppressed in which the ink IN reaches the third communication hole 218 located at an end portion of the horizontally bent path portion 241. Accordingly, a situation is suppressed in which the ink IN flows into the second buffer chamber 212, and thus leakage of the ink IN to the outside is suppressed.

Figure 20:
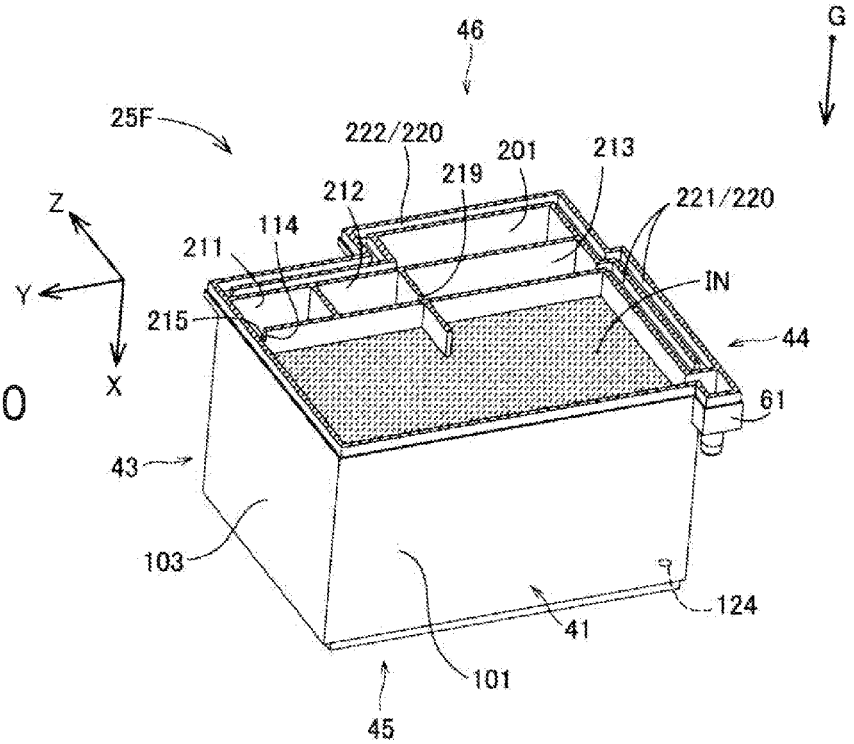
FIG. 20 is a schematic perspective view showing a state when the ink tank according to the sixth embodiment is disposed in an orientation in which a fifth wall portion faces vertically downward.

FIG. 20 is a schematic perspective view showing a state when the ink tank 25F containing the ink IN is disposed in an orientation in which the fifth surface 45 faces vertically downward. In FIG. 20, the first sheet member 51*a* is not illustrated for the sake of convenience. In the ink tank 25F, the first atmospheric air introducing inlet 114 is provided at a positon closer to the sixth wall portion 106. Accordingly, when the ink tank 25F is disposed such that the fifth surface 45 faces vertically downward, the first atmospheric air introducing inlet 114 is located at an upper position. Accordingly, a situation is suppressed in which the ink IN contained in the ink containing portion 100 flows into the first buffer chamber 211 via the first atmospheric air introducing inlet 114. Also, a situation is suppressed in which the first atmospheric air introducing inlet 114 is closed by the ink IN contained in the ink containing portion 100, and thus a situation is suppressed in which the admission of atmospheric air into the ink containing portion 100 is blocked. Accordingly, a situation is suppressed in which the ink IN is forced to the outside due to the expansion of the air contained in the ink containing portion 100.

Furthermore, in the ink tank 25F, the communication path 219 between the second buffer chamber 212 and the third buffer chamber 213 is also provided at a position closer to the sixth wall portion 106. For this reason, even if the ink IN reaches the second buffer chamber 212 via the first buffer chamber 211 and the second flow path groove 230, a situation is suppressed in which the ink IN flows from the second buffer chamber 212 into the third buffer chamber 213. Likewise, in the ink tank 25F, the connection portion between the third buffer chamber 213 and the first flow path groove 220 is also provided at a position closer to the sixth wall portion 106, and thus a situation is also suppressed in which the ink IN flows from the third buffer chamber 213 into the first flow path groove 220. In this way, even when the ink tank 25F is brought into an orientation in which the fifth surface 45 faces vertically downward, a situation is suppressed in which the ink IN contained in the ink containing portion 100 reaches the atmospheric air chamber 201, and thus leakage of the ink IN to the outside is suppressed.

Figure 21:
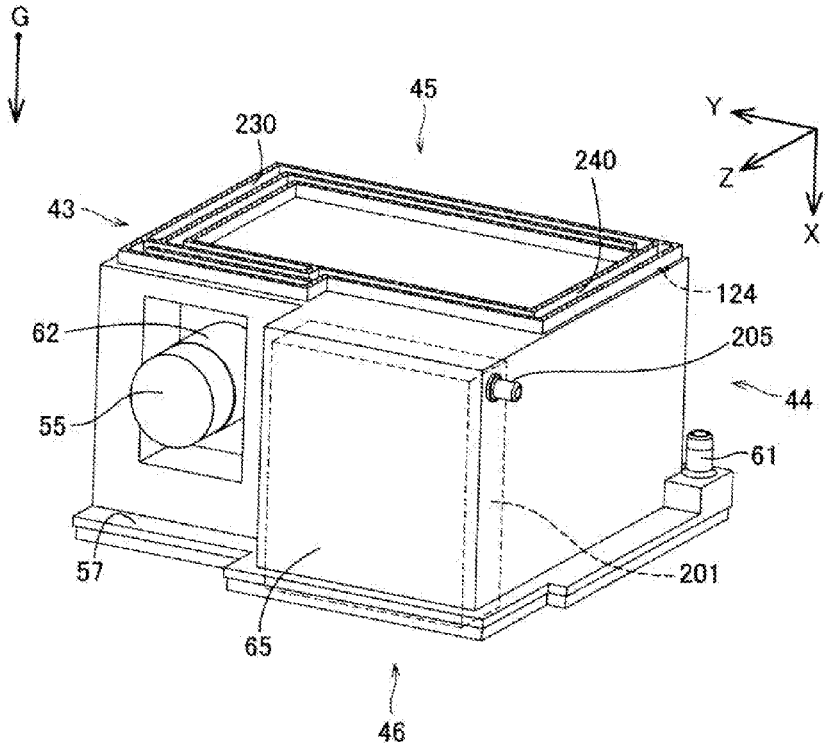
FIG. 21 is a schematic perspective view showing a state when the ink tank according to the sixth embodiment is disposed in an orientation in which a sixth surface faces vertically downward.

FIG. 21 is a schematic perspective view showing a state when the ink tank 25F containing the ink IN is disposed in an orientation in which the sixth surface 46 faces vertically downward. In FIG. 21, the second sheet member 51*b* is not illustrated for the sake of convenience. In the ink tank 25F, the air intake portion 205 is connected to the atmospheric air chamber 201 at a position closer to the fifth surface 45 side. For this reason, in this orientation, even if the ink IN flows into the atmospheric air chamber 201, a situation is suppressed in which the ink IN that has flowed into the atmospheric air chamber 201 reaches the air intake portion 205 located in an upper position. Also, in the ink tank 25F, the second atmospheric air introducing inlet 124 is provided at a position closer to the fifth surface 45 side. Accordingly, a situation is suppressed in which the second atmospheric air introducing inlet 124 is closed by the ink IN contained in the ink containing portion 100, and the admission of atmospheric air into the ink containing portion 100 is blocked. Accordingly, a situation is suppressed in which the ink IN is forced to the outside due to the expansion of the air contained in the ink containing portion 100.

Effect of Suppressing Ink Leakage when Ink Tank is in Reversed Orientation

Figure 22:
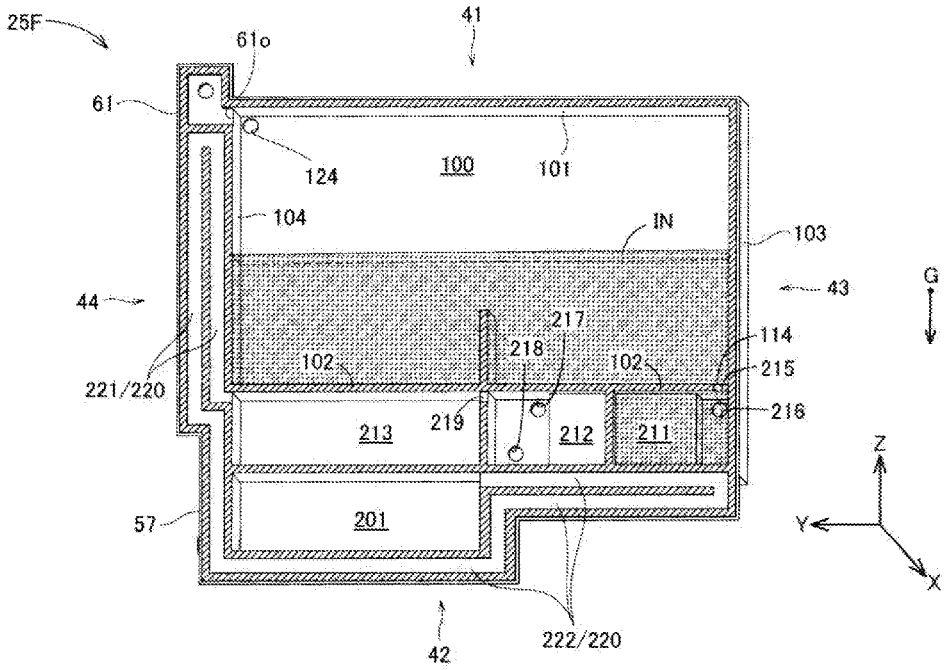
FIG. 22 is a schematic perspective view showing a state when the ink tank according to the sixth embodiment is in a reversed orientation.
Figure 23:
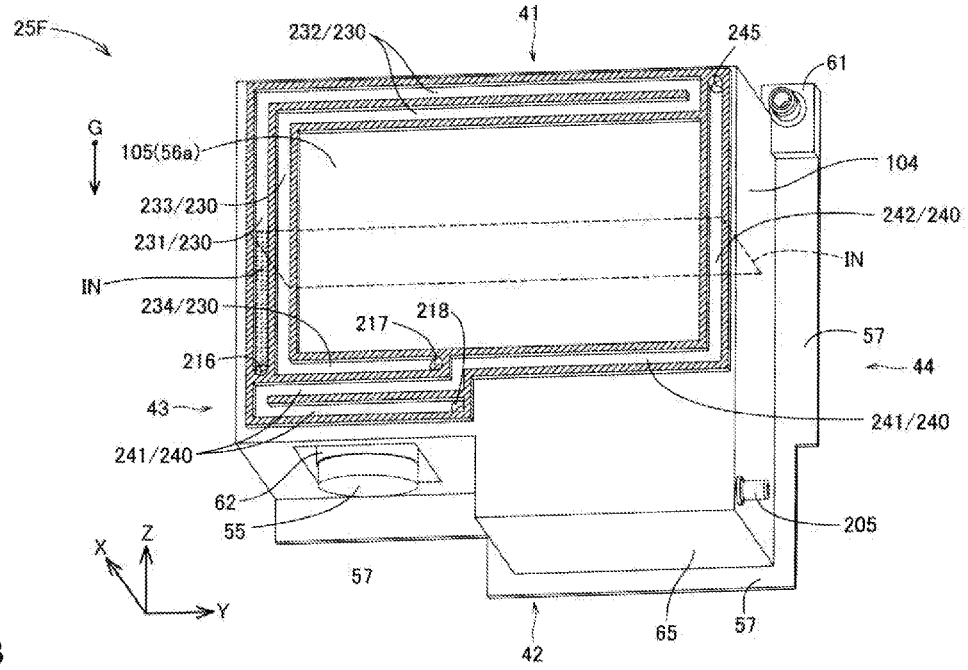
FIG. 23 is a schematic perspective view showing a state when the ink tank according to the sixth embodiment is in a reversed orientation.

FIG. 22 is a schematic perspective view of the ink tank 25F when it is in the reversed orientation as viewed from the sixth surface 46 side. FIG. 23 is a schematic perspective view of the ink tank 25F when it is in the reversed orientation as viewed from the fifth surface 45 side. In FIGS. 22 and 23, the first sheet member 51*a* and the second sheet member 51*b* are not illustrated for the sake of convenience.

When the ink tank 25F is in the reversed orientation, the ink IN contained in the ink containing portion 100 is stored on the second wall portion 102 side (FIG. 22). At this time, the ink IN flows into the first buffer chamber 211 via the first atmospheric air introducing inlet 114, and reaches the first vertical path portion 231 of the second flow path groove 230 (FIG. 23). However, because the first vertical path portion 231 of the second flow path groove 230 extends to a position closer to the first surface 41 side of the ink tank 25F, in the reversed orientation, a situation is suppressed in which the ink IN passes through the first vertical path portion 231 and reaches the horizontally bent path portion 232. Accordingly, in the reversed orientation as well, a situation is suppressed in which the ink IN reaches the second buffer chamber 212, and thus leakage of the ink IN to the outside is suppressed.

Also, when the ink tank 25F is in the reversed orientation, the second atmospheric air introducing inlet 124 is located in a region that is above the ink containing portion 100 and where the air is present (FIG. 22). For this reason, the air that has expanded in the ink containing portion 100 can flow out to the third flow path groove 240 via the second atmospheric air introducing inlet 124 (FIG. 23). The air that has flowed out to the third flow path groove 240 passes through the vertical path portion 242 and the horizontally bent path portion 241 of the third flow path groove 240 in sequence, flows into the second buffer chamber 212 via the third communication hole 218 (FIG. 22), and then flows into the third buffer chamber 213 via the communication path 219. The air that has flowed into the third buffer chamber 213 passes through the horizontally bent path portion 221 and the vertically bent path portion 222 of the first flow path groove 220 in sequence, flows into the atmospheric air chamber 201, and flows to the outside via the air intake portion 205. In the sixth embodiment, the atmospheric air path corresponds to a subordinate concept of the second atmospheric air communication portion.

As described above, with the ink tank 25F according to the sixth embodiment, even when the ink tank 25F is in the reversed orientation, the air flow path to the ink containing portion 100 is formed. Accordingly, in the reversed orientation, even if the air contained in the ink containing portion 100 expands, leakage that occurs as a result of the ink IN being forced to the outside due to the expansion of the air is suppressed.

Function of Partition Wall of Ink Containing Portion

Figure 24:
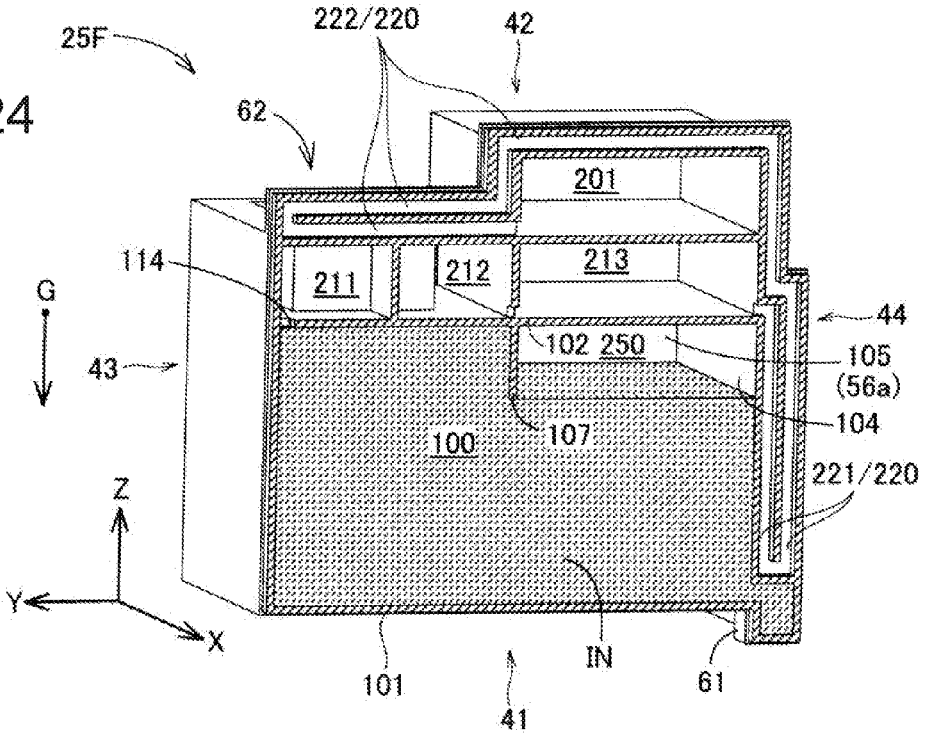
FIG. 24 is a schematic perspective view showing the ink tank according to the sixth embodiment, with an ink containing portion being completely full.

FIG. 24 is a schematic perspective view of the ink tank 25F when the ink containing portion 100 is completely full. As described above, the ink containing portion 100 includes the partition wall 107. With this configuration, in an upper region, which is on the fourth surface 44 side, of the ink containing portion 100, a space 250 is defined, the space 250 being closed by the second wall portion 102 on its upper portion, and the partition wall 107, the fourth wall portion 104, the fifth wall portion 105 and the sixth wall portion 106 on its sides. Even when the ink IN is loaded from the ink injection portion 62 and the ink containing portion 100 becomes completely full, the space 250 is filled with atmospheric air, and thus entry of the ink IN is suppressed.

As described above, in the ink tank 25F, even when the ink containing portion 100 is completely full, the space in which the air is present is formed in the ink containing portion 100. Accordingly, even when the ink tank 25F is brought into the reversed orientation, with the ink containing portion 100 being completely full, the air present in the space 250 suppresses a situation in which the second atmospheric air introducing inlet 124 is closed by the ink IN. Accordingly, when the ink tank 25F is brought into the reversed orientation, a situation is further suppressed in which the admission of atmospheric air into the ink containing portion 100 is blocked. In the ink tank 25F, the ink capacity of the ink containing portion 100 corresponds to an amount obtained by subtracting the volume of the space 250 from the volume of the ink containing portion 100.

Conclusion

As described above, with the ink tank 25F according to the sixth embodiment, even when the ink tank 25F is brought into an orientation rotated from the reference orientation or placed in an environment in which the air contained in the ink containing portion 100 expands, leakage of the ink IN to the outside is suppressed. In addition thereto, with the ink tank 25F according to the sixth embodiment, the tank unit 20 including the ink tank, and the printer 10 including the tank unit 20, various advantageous effects described in connection with the embodiments above can be achieved.

G. Seventh Embodiment

Figure 25:
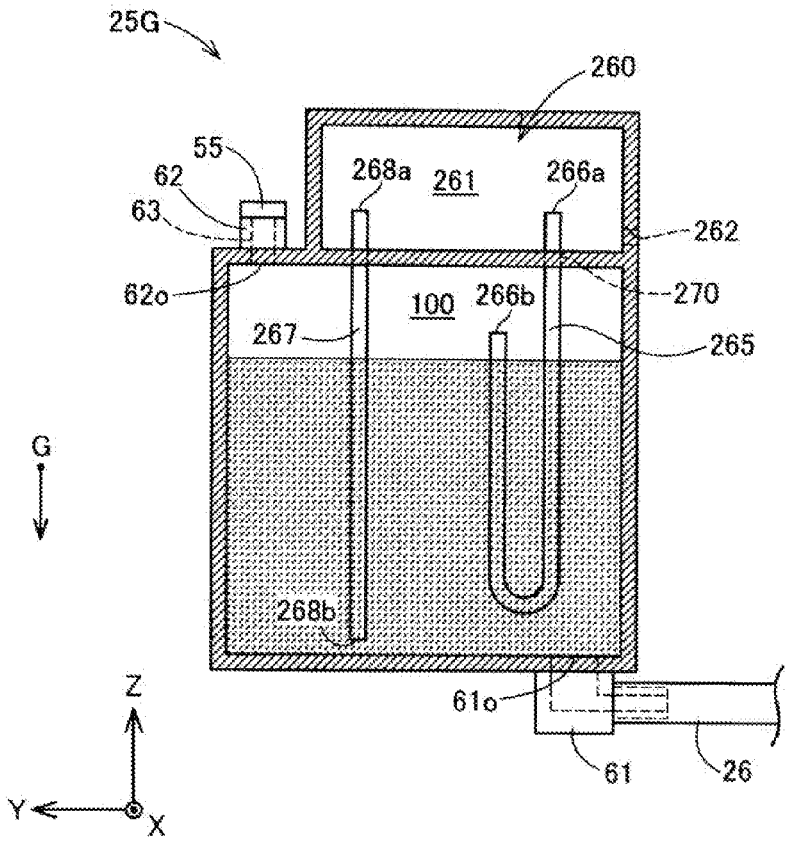
FIG. 25 is a schematic cross-sectional view showing a configuration of an ink tank according to a seventh embodiment.

FIG. 25 is a schematic cross-sectional view showing a configuration of an ink tank 25G according to a seventh embodiment of the invention. The basic configuration of the ink tank 25G according to the seventh embodiment is the same as that of the ink tanks described in the embodiments above. The ink tank 25G can be attached to a tank unit 20 of a printer 10 having the same configuration as that described in the first embodiment. In the following description and the diagrams that will be referred to, unless otherwise stated, the same constituent elements as those described in the embodiments given above or corresponding constituent elements and members are given the same names and reference numerals as those used in the embodiments given above.

It is sufficient that the ink tank 25G according to the seventh embodiment is configured as a hollow container, and there is no particular limitation on the body shape thereof. The ink tank 25G may have a substantially rectangular shape or a substantially cylindrical shape. The ink tank 25G includes an ink containing portion 100 and an atmospheric air introducing portion 260.

In the ink tank 25G, the entire wall portion surrounding the ink containing portion 100 is configured to be translucent. With this configuration, the user can view the amount of ink contained in the ink containing portion 100 from the outside. At a lower end of the ink containing portion 100, the ink supply portion 61 is provided. At an upper end of the ink containing portion 100, the ink injection portion 62 is provided.

The atmospheric air introducing portion 260 includes an atmospheric air chamber 261, a first tube member 265 and a second tube member 267. The atmospheric air chamber 261 is provided above the ink containing portion 100. An air intake inlet 262 for drawing outside atmospheric air is provided in a lower end area of the atmospheric air chamber 261.

The first tube member 265 is a tubular member having a substantially U shape, and has two end portions 266*a* and 266*b* that are open in the same direction. The first tube member 265 passes through a through hole 270 provided in a wall portion between the atmospheric air chamber 261 and the ink containing portion 100. The first end portion 266*a* of the first tube member 265 is located within the atmospheric air chamber 261, and the second end portion 266*b* is located in an upper region of the ink containing portion 100. It is desirable that a sealing member is provided between the through hole 270 and the first tube member 265.

The second tube member 267 is a tubular member extending substantially linearly. The second tube member 267 passes through a through hole 271 provided in the wall portion between the atmospheric air chamber 261 and the ink containing portion 100. A first end portion 268*a* of the second tube member 267 is located within the atmospheric air chamber 261, and a second end portion 268*b* of the same is located in a lower region of the ink containing portion 100. It is desirable that a sealing member is provided between the through hole 271 and the second tube member 267.

With the ink tank 25G, when it is in the reference orientation, atmospheric air is introduced into the ink containing portion 100 via the first tube member 265. When it is brought into the reversed orientation, an air flow path between the ink containing portion 100 and the atmospheric air chamber 261 is formed by the second tube member 267.

As described above, with the ink tank 25G according to the seventh embodiment as well, even when the air contained in the ink containing portion 100 expands after the ink tank is brought into the reversed orientation, leakage of the ink IN to the outside is suppressed. In the seventh embodiment, the first tube member 265 corresponds to a subordinate concept of the first atmospheric air communication portion of the invention, and the second tube member 267 corresponds to a subordinate concept of the second atmospheric air communication portion of the invention.

H. Eighth Embodiment

Figure 26:
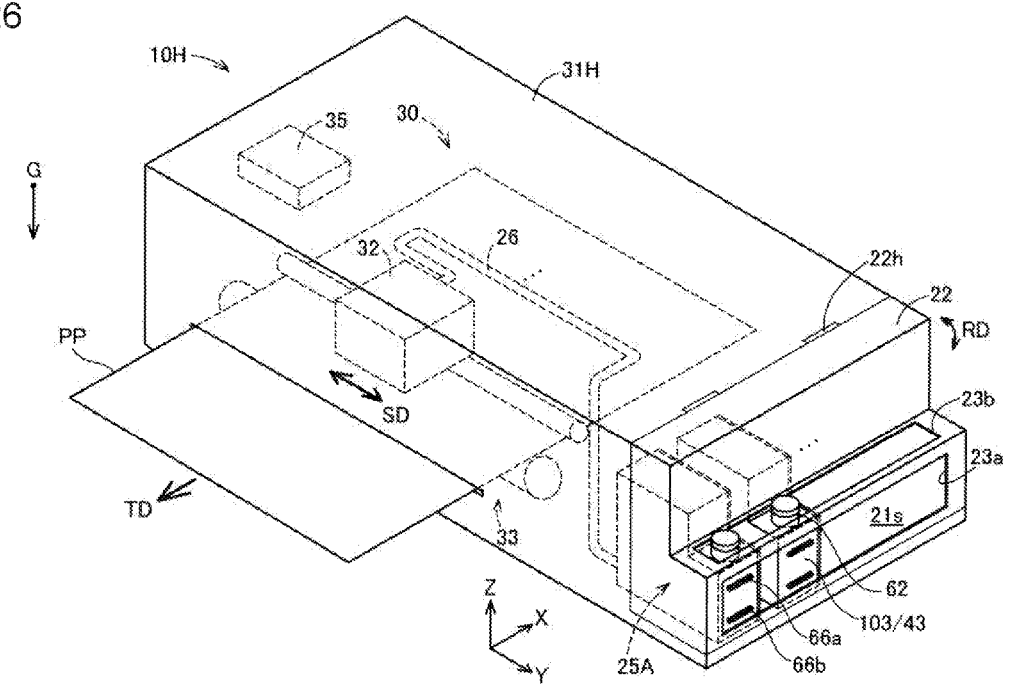
FIG. 26 is a schematic diagram showing a configuration of a printer according to an eighth embodiment.

FIG. 26 is a schematic diagram showing a configuration of a printer 10H according to an eighth embodiment of the invention. The printer 10H according to the eighth embodiment has substantially the same configuration as that of the printer 10 according to the first embodiment except that the plurality of ink tanks 25A are housed, together with the printing unit 30, in a casing portion 31H of the printer 10H. In the following description and the diagrams that will be referred to, the same constituent elements as those described in the first embodiment or corresponding constituent elements are given the same names and reference numerals as those used in the first embodiment. The casing portion 31H of the printer 10H includes a lid portion 22 having a first window portion 23*a* and a second window portion 23*b* similar to those provided in the casing portion 21 of the tank unit 20 according to the first embodiment (FIG. 1).

With the printer 10H of the eighth embodiment, because the ink tanks 25A are integrally housed within the main body, the installation efficiency of the printer 10H is enhanced. Also, with the ink tanks 25A of the printer 10H of the eighth embodiment, various advantageous effects similar to those described in connection with the first embodiment, such as suppression of leakage of the ink IN, can be achieved. In the printer 10H of the eighth embodiment, it is possible to use, instead of the ink tank 25A according to the first embodiment, the ink tanks 25B to 25G of the other embodiments.

I. Variations

I1. Variation 1

The configurations of the embodiments described above can be combined as appropriate. For example, in the ink tanks 25C, 25D and 25E according to the third embodiment, the fourth embodiment and the fifth embodiment, it is possible to, as in the ink tank 25B according to the second embodiment, provide the first atmospheric air introducing portion 110 on the third surface 43 side, and the second atmospheric air introducing portion 120 on the fourth surface 44 side. It is also possible to provide the partition wall 107 of the ink tank 25F according to the sixth embodiment in the ink containing portions 100 of the ink tanks 25A to 25E, 25G of the other embodiments.

I2. Variation 2

The positions at which the first atmospheric air introducing inlet 114 and the second atmospheric air introducing inlet 124 are formed are not limited to the positions described in the embodiments above. The first atmospheric air introducing inlet 114 may be provided at a position closer to the fourth wall portion 104 than the third wall portion 103, and the second atmospheric air introducing inlet 124 may be provided at a position closer to the third wall portion 103 than the fourth wall portion 104. It is sufficient that the first atmospheric air introducing inlet 114 and the second atmospheric air introducing inlet 124 are provided such that, when the ink tank having the ink containing portion 100 containing the ink IN in an amount equal to ½ of its ink capacity is in the reference orientation, the first atmospheric air introducing inlet 114 is located in a region where the air is present, and the second atmospheric air introducing inlet 124 is located in a region where the ink IN is present. It is sufficient that the first atmospheric air introducing inlet 114 and the second atmospheric air introducing inlet 124 are provided at different height positions at least when the ink tank is in the reference orientation.

I3. Variation 3

The ink tanks 25A to 25F according to the embodiments described above have a shape composed of a combination of two substantially rectangular parallelepiped shapes of different sizes. However, the ink tanks 25A to 25F may have other shapes. The ink tanks 25A to 25F may be changed as appropriate so as to have various shapes such as a substantially triangular prism shape, a substantially quadrangular prism shape, a substantially pentagonal prism shape, a substantially cylindrical shape and a substantially elliptic cylindrical shape. Also, the ink tanks 25A to 25F do not necessarily need to be constituted by the integrally molded case members 50 and 50F and the sheet members 51, 51*a* and 51*b*. The ink tanks 25A to 25F may be produced by, for example, bonding together a plurality of plate-like members such as plastic plates.

I4. Variation 4

In the embodiments described above, the reference orientation of the ink tanks 25A to 25G is an orientation when ink is injected into the ink tank 25A by the user, and also is an orientation when the ink is supplied to the print head portion 32 to discharge ink droplets. However, the reference orientation of the ink tanks 25A to 25G may be different from the orientation when the ink is supplied to the print head portion 32 to discharge ink droplets. Alternatively, the reference orientation of the ink tanks 25A to 25G may be different from the orientation when ink is injected into the ink tank 25A by the user.

I5. Variation 5

In the ink tanks 25A to 25F of the embodiments described above, the third wall portion 103 of the ink containing portion 100 functions as the visible portion for allowing the amount of ink IN contained in the ink containing portion 100 to be visible from the outside. However, in the ink tanks 25A to 25F, the other walls of the ink containing portion 100 may function as the visible portion. For example, a part or all of the fourth wall portion 104, the fifth wall portion 105 and the sixth wall portion 106 may be configured to function as the visible portion. Also, the ink tanks 25A to 25G of the embodiments described above do not necessarily have the visible portion.

I6. Variation 6

In the ink tanks 25A to 25F of the embodiments described above, two mark portions 66*a* and 66*b* are provided to the wall surface of the third wall portion 103 that functions as the visible portion. However, in the ink tanks 25A to 25F of the above embodiments, both or either one of the two mark portions 66*a* and 66*b* may be omitted.

I7. Variation 7

The ink tanks 25A to 25G of the embodiments described above include the ink injection portion 62 for the user to load ink IN into the ink containing portion 100. However, the ink injection portion 62 may be omitted. Ink may be loaded into the ink tanks 25A to 25G only during production at the plants. In the ink tanks 25A to 25G of the embodiments described above, the ink injection inlet 62*o* of the ink injection portion 62 is open in the second wall portion 102 of the ink containing portion 100, and is located above the ink IN contained in the ink containing portion 100 even when the ink containing portion 100 is completely full. However, the ink injection inlet 62*o* may be located in a wall portion other than the second wall portion 102. For example, the ink injection inlet 62*o* may be provided so as to be open in the direction of the arrow Y in the third wall portion 103 or the fourth wall portion 104.

F8. Variation 8

The ink tanks 25A to 25G of the embodiments described above are housed in the casing portion 21 of the tank unit 20 or the casing portion 31H of the printer 10H. However, the ink tanks 25A to 25G of the embodiments described above may be, instead of being housed in the casing portions 21 and 31H, connected to the print head portion 32 via the tube 26, with the entire ink tank being exposed to the outside or being held by a cage-like holding member.

F9. Variation 9

In the embodiments described above, the ink tanks 25A to 25G are configured so as to be capable of supplying the ink IN to the print head portions 32 of the printers 10 and 10H. However, the configuration of the ink tanks 25A to 25G of the embodiments described above may be applied to a tank containing a liquid supplied to a liquid ejection system other than a printer. For example, the configuration may be applied to a detergent tank for supplying a liquid detergent to a detergent ejection apparatus that ejects the detergent. Alternatively, the configuration of the ink tanks 25A to 25G of the embodiments described above may be applied to a tank for supplying a liquid to a liquid consuming system that consumes the liquid by a method other than ejection.

The invention is not limited to the embodiments, examples and variations described above, and can be implemented by various configurations within a range that does not depart from the spirit and scope of the invention. For example, the technical features in the embodiments, examples and variations corresponding to the technical features in respective embodiments described in the summary section can be replaced or combined as appropriate in order to solve some or all of the above-described problems or achieve some or all of the above-described effects. Also, a technical feature that is not described as essential in the specification may be removed as appropriate.

What is claimed is:

1. A tank capable of supplying a liquid to a liquid ejection head, the tank comprising:

a liquid containing portion capable of containing the liquid;

an atmospheric air introducing portion capable of introducing outside atmospheric air into the liquid containing portion;

a liquid injection portion capable of injecting the liquid into the liquid containing portion from outside; and a sealing member detachably attached to the liquid injection portion, wherein the atmospheric air introducing portion includes a first atmospheric air communication portion and a second atmospheric air communication portion that communicate with the liquid containing portion, the first atmospheric air communication portion includes a first atmospheric air introducing inlet that is open to the liquid containing portion, the second atmospheric air communication portion includes a second atmospheric air introducing inlet that is open to the liquid containing portion, and in a state in which the liquid containing portion contains the air and the liquid in an amount occupying ½ of a capacity of the liquid of the liquid containing portion, (i) when the tank is in a liquid injecting orientation, which is an orientation when the liquid is injected from the liquid injection portion, the first atmospheric air introducing inlet is located in a region where the air is present, and the second atmospheric air introducing inlet is located in a region where the liquid is present, and (ii) when the tank is in a reversed orientation in which the tank has been rotated upside down by 180° from the liquid injecting orientation, the first atmospheric air introducing inlet is located in a region where the liquid is present, and the second atmospheric air introducing inlet is located in a region where the air is present.

2. The tank according to claim 1, wherein the liquid containing portion includes a first wall portion, a second wall portion that is located opposite to the first wall portion, a third wall portion that is located between the first wall portion and the second wall portion in a direction extending from the first wall portion toward the second wall portion and intersects with the first wall portion and the second wall portion, and a fourth wall portion that is located opposite to the third wall portion and intersects with the first wall portion and the second wall portion, when the tank is in the liquid injecting orientation, the first wall portion is located at a position that is lower than the second wall portion, the third wall portion and the fourth wall portion, the first atmospheric air introducing inlet is located at a position that is closer to the second wall portion than the first wall portion and is closer to the third wall portion than the fourth wall portion, and the second atmospheric air introducing inlet is located at a position that is closer to the first wall portion than the second wall portion and is closer to the fourth wall portion than the third wall portion.

3. The tank according to claim 2, wherein the atmospheric air introducing portion further includes a third atmospheric air communication portion that communicates with the liquid containing portion, the third atmospheric air communication portion includes a third atmospheric air introducing inlet that is open to the liquid containing portion, and the third atmospheric air introducing inlet is located at a position that is closer to the first wall portion than the first atmospheric air introducing inlet and is closer to third wall portion than the second atmospheric air introducing inlet.

4. The tank according to claim 2, wherein the atmospheric air introducing portion further includes a third atmospheric air communication portion that communicates with the liquid containing portion, the third atmospheric air communication portion includes a third atmospheric air introducing inlet that is open to the liquid containing portion, and the third atmospheric air introducing inlet is located at a position closer to the fourth wall portion than the first atmospheric air introducing inlet and is closer to the second wall portion than the second atmospheric air introducing inlet.

5. The tank according to claim 2, wherein the liquid containing portion further includes a fifth wall portion that intersects with the first wall portion, the second wall portion, the third wall portion and the fourth wall portion, and a sixth wall portion that is located opposite to the fifth wall portion and intersects with the first wall portion, the second wall portion, the third wall portion and the fourth wall portion, the first wall portion, the second wall portion, the third wall portion, the fourth wall portion and the fifth wall portion are constituted by wall portions of an integrally molded housing member, and the sixth wall portion is constituted by a film-like member that is bonded to the housing member.

6. The tank according to claim 5, wherein the first atmospheric air communication portion includes a first back path portion provided in a back surface of the fifth wall portion that is opposite to the liquid containing portion, and the second atmospheric air communication portion includes a second back path portion provided in the back surface.

7. The tank according to claim 5, wherein the first atmospheric air introducing inlet is provided at a position closer to the fifth wall portion, and the second atmospheric air introducing inlet is provided at a position closer to the sixth wall portion.

8. The tank according to claim 2, wherein the liquid containing portion further includes a fifth wall portion that intersects with the first wall portion, the second wall portion, the third wall portion and the fourth wall portion, and a sixth wall portion that is located opposite to the fifth wall portion and intersects with the first wall portion, the second wall portion, the third wall portion and the fourth wall portion, the first wall portion, the second wall portion, the third wall portion and the fourth wall portion are constituted by wall portions of an integrally molded housing member, and the fifth wall portion and the sixth wall portion are constituted by film-like members that are bonded to the housing member.

9. The tank according to claim 2, wherein the first atmospheric air communication portion and the second atmospheric air communication portion each include a path part that passes through a height position between the first wall portion and a midpoint between the first wall portion and the second wall portion.

10. The tank according to claim 1, wherein the atmospheric air introducing portion further includes a third atmospheric air communication portion that communicates with the liquid containing portion, the third atmospheric air communication portion includes a third atmospheric air introducing inlet that is open to the liquid containing portion, and in a state in which the liquid containing portion contains the air and the liquid in an amount equal to ⅔ of a capacity of the liquid of the liquid containing portion, when the tank is in an orientation in which the first atmospheric air introducing inlet and the second atmospheric air introducing inlet are located in a region where the liquid is present, the third atmospheric air introducing inlet is located in a region where the air is present.

11. The tank according to claim 1, wherein the second atmospheric air communication portion includes a tubular path portion, which is an atmospheric air path constituted by a tubular member, and the second atmospheric air introducing inlet is open at an end portion of the tubular path portion disposed in the liquid containing portion.

12. The tank according to claim 1, comprising a common atmospheric air intake portion having an atmospheric air opening that communicates with the first atmospheric air communication portion and the second atmospheric air communication portion and is open to outside so as to be capable of drawing atmospheric air.

13. The tank according to claim 1, wherein the first atmospheric air communication portion includes a first atmospheric air opening that is open to outside so as to be capable of drawing atmospheric air, and the second atmospheric air communication portion includes a second atmospheric air opening that is open to outside so as to be capable of drawing atmospheric air.

14. The tank according to claim 1, wherein the liquid injection portion includes a liquid injection inlet that is open to the liquid containing portion and is provided to allow the liquid to flow into the liquid containing portion, and when the tank is in the liquid injecting orientation, the first atmospheric air communication portion includes an atmospheric air path that is located at a position that is higher than the liquid injection inlet.

15. The tank according to claim 14, wherein when the tank is in the liquid injecting orientation and the liquid containing portion is filled with the liquid, the liquid injection inlet is located above the liquid contained in the liquid containing portion.

16. A liquid ejection system comprising:

the tank according to claim 1;

a liquid ejection head; and an outer jacket that houses the tank and the liquid ejection head, wherein the tank includes a visible portion that allows a position of a surface of the liquid contained in the liquid containing portion to be visible, the outer jacket includes a window portion that allows the visible portion of the tank to be visible from outside, and when the tank is in the liquid injecting orientation, the first atmospheric air introducing inlet is located at a position that is higher than an upper end of the window portion.

17. A tank capable of supplying a liquid to a liquid ejection head, the tank comprising:

a liquid containing portion capable of containing the liquid;

an atmospheric air introducing portion capable of introducing outside atmospheric air into the liquid containing portion;

a liquid injection portion capable of injecting the liquid into the liquid containing portion from outside; and a sealing member detachably attached to the liquid injection portion, wherein the atmospheric air introducing portion includes a first atmospheric air communication portion and a second atmospheric air communication portion that communicate with the liquid containing portion, the first atmospheric air communication portion includes a first atmospheric air introducing inlet that is open to the liquid containing portion, the second atmospheric air communication portion includes a second atmospheric air introducing inlet that is open to the liquid containing portion, the liquid containing portion includes a first wall portion, a second wall portion that is located opposite to the first wall portion, a third wall portion that is located between the first wall portion and the second wall portion in a direction extending from the first wall portion toward the second wall portion and intersects with the first wall portion and the second wall portion, and a fourth wall portion that is located opposite to the third wall portion and intersects with the first wall portion and the second wall portion, when the tank is in a liquid injecting orientation, which is an orientation when the liquid is injected from the liquid injection portion, the first wall portion is located at a position that is lower than the second wall portion, the third wall portion and the fourth wall portion, the first atmospheric air introducing inlet is located at a position that is closer to the second wall portion than the first wall portion and is closer to the third wall portion than the fourth wall portion, and the second atmospheric air introducing inlet is located at a position that is closer to the first wall portion than the second wall portion and is closer to the fourth wall portion than the third wall portion.

* * * * *